US011530474B2

(12) United States Patent
Fujita et al.

(10) Patent No.: US 11,530,474 B2
(45) Date of Patent: Dec. 20, 2022

(54) FE—AL-BASED PLATED HOT-STAMPED MEMBER AND MANUFACTURING METHOD OF FE—AL-BASED PLATED HOT-STAMPED MEMBER

(71) Applicant: NIPPON STEEL CORPORATION, Tokyo (JP)

(72) Inventors: Soshi Fujita, Tokyo (JP); Yuki Suzuki, Tokyo (JP); Masahiro Fuda, Tokyo (JP); Jun Maki, Tokyo (JP); Hideaki Irikawa, Tokyo (JP); Tatsuya Kubota, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 23 days.

(21) Appl. No.: 16/634,346

(22) PCT Filed: Feb. 15, 2019

(86) PCT No.: PCT/JP2019/005659
§ 371 (c)(1),
(2) Date: Jan. 27, 2020

(87) PCT Pub. No.: WO2019/160106
PCT Pub. Date: Aug. 22, 2019

(65) Prior Publication Data

US 2021/0095368 A1 Apr. 1, 2021

(30) Foreign Application Priority Data

Feb. 15, 2018 (JP) ..... JP2018-025328

(51) Int. Cl.
*C23C 2/12* (2006.01)
*B32B 15/10* (2006.01)
(Continued)

(52) U.S. Cl.
CPC ..... *C23C 2/12* (2013.01); *B21D 22/022* (2013.01); *C21D 8/0226* (2013.01);
(Continued)

(58) Field of Classification Search
None
See application file for complete search history.

(56) References Cited

U.S. PATENT DOCUMENTS

2013/0029172 A1* 1/2013 Drillet ..... C23C 2/40 428/601
2013/0199676 A1 8/2013 Tomokiyo et al.
(Continued)

FOREIGN PATENT DOCUMENTS

EP 1380666 A1 1/2004
EP 2 695 963 A1 2/2014
(Continued)

OTHER PUBLICATIONS

Zhou et al., Comparative effects of Al—Si and galvannealed coatings on the properties of resistance spot welded hot stamping steel joints, Mar. 24, 2016, Journal of Materials Processing Technology, 236, 64-72 (Year: 2016).*
(Continued)

*Primary Examiner* — Mary I Omori
(74) *Attorney, Agent, or Firm* — Birch, Stewart, Kolasch & Birch, LLP

(57) ABSTRACT

Fe-Al-based plated hot-stamped member exhibiting excellent formed part corrosion resistance and post-coating corrosion resistance and manufacturing method. The hot-stamping member includes Fe-Al-based plated layer on one or both surfaces of a base material, the base material has a predetermined steel component, Fe-Al-based plated layer has a thickness of 10 μm or more and 60 μm or less, formed by A, B, C and D layers sequentially from a surface toward
(Continued)

the base material, and each of the four layers is a Fe-Al-based intermetallic compound containing Al, Fe, Si, Mn and Cr for predetermined contents with the balance made up of impurities, the D layer further contains Kirkendall voids each of which cross-sectional area is 3 $\mu m^2$-30 $\mu m^2$ for 10 pieces/6000 $\mu m^2$ or more and 40 pieces/6000 $\mu m^2$ or less.

4 Claims, 3 Drawing Sheets

(51) Int. Cl.

| | |
|---|---|
| ***B21D 22/02*** | (2006.01) |
| ***C21D 8/02*** | (2006.01) |
| ***C22C 21/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/42*** | (2006.01) |
| ***C22C 38/60*** | (2006.01) |
| ***C23C 2/28*** | (2006.01) |
| ***C23C 2/40*** | (2006.01) |
| ***C23C 28/02*** | (2006.01) |

(52) U.S. Cl.
CPC ..... *C21D 8/0236* (2013.01); *C21D 8/0273* (2013.01); *C22C 21/02* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/24* (2013.01); *C22C 38/26* (2013.01); *C22C 38/28* (2013.01); *C22C 38/30* (2013.01); *C22C 38/32* (2013.01); *C22C 38/42* (2013.01); *C22C 38/60* (2013.01); *C23C 2/28* (2013.01); *C23C 2/40* (2013.01); *C23C 28/021* (2013.01)

(56) References Cited

U.S. PATENT DOCUMENTS

| | | | | |
|---|---|---|---|---|
| 2015/0024237 | A1 | 1/2015 | Tanahashi et al. | |
| 2016/0060735 | A1 | 3/2016 | Maki et al. | |
| 2018/0216219 | A1 | 8/2018 | Nakajima et al. | |
| 2019/0003029 | A1 | 1/2019 | Oh et al. | |
| 2019/0366686 | A1 | 12/2019 | Fuda et al. | |
| 2020/0032360 | A1 * | 1/2020 | Sengoku | C22C 38/00 |

FOREIGN PATENT DOCUMENTS

| | | | | |
|---|---|---|---|---|
| JP | 9-202953 | A | 8/1997 | |
| JP | 2003-181549 | A | 7/2003 | |
| JP | 2004-244704 | A | 9/2004 | |
| JP | 2007-314874 | A | 12/2007 | |
| JP | 2008-285757 | A | 11/2008 | |
| JP | 2009-263692 | A | 11/2009 | |
| KR | 10-2015-0127725 | A | 11/2015 | |
| WO | WO-02103073 | A2 * | 12/2002 | C23C 2/12 |
| WO | WO 2012/053642 | A1 | 4/2012 | |
| WO | WO 2013/133270 | A1 | 9/2013 | |
| WO | WO 2017/017905 | A1 | 2/2017 | |
| WO | WO 2017/111525 | A1 | 6/2017 | |
| WO | WO 2018/142534 | A1 | 8/2018 | |

OTHER PUBLICATIONS

International Search Report for PCT/JP2019/005659 dated Apr. 23, 2019.

Written Opinion of the International Searching Authority for PCT/JP2019/005659 (PCT/ISA/237) dated Apr. 23, 2019.

Zhong-Xiang et al., "Cracking and interfacial debonding of the Al—Si coating in hot stamping of pre-coated boron steel," Applied Surface Science, vol. 316, 2014 (published online Aug. 18, 2014), pp. 595-603.

* cited by examiner

FE—AL-BASED PLATED HOT-STAMPED MEMBER AND MANUFACTURING METHOD OF FE—AL-BASED PLATED HOT-STAMPED MEMBER

TECHNICAL FIELD

The present invention relates to a Fe-Al-based plated hot-stamped member and a manufacturing method of the Fe-Al-based plated hot-stamped member.

BACKGROUND ART

In recent years, a steel sheet enabling both high-strength and high-formability has been demanded in uses of an automotive steel sheet (for example, a pillar, a door impact beam, a bumper beam, and so on of an automobile, and the like). There is TRIP (transformation induced plasticity) steel using martensite transformation of retained austenite as one of steel sheets corresponding to the demand as stated above. A high-strength steel sheet with excellent formability and strength of approximately 1000 MPa class can be manufactured by this TRIP steel. However, it is difficult to secure the formability in ultrahigh-strength steel with higher strength (for example, 1500 MPa or more). Besides, there are problems in which shape fixability after forming is bad and dimensional accuracy of a formed product deteriorates.

As mentioned above, a method which has been recently attracted attention is hot-stamping (it is also called hot pressing, die quenching, press quenching, and so on) against a method performing forming at around room temperature (what is called a cold-pressing method). The hot-stamping is a manufacturing method where a steel sheet is subjected to hot press forming just after heating to an austenite region at 800° C. or more to thereby secure ductility of a material, and the material is hardened by quenching with a metal die during holding at a bottom dead center to obtain a desired high-strength material after the pressing. According to this method, an automotive member which is also excellent in the shape fixability after the forming can be obtained.

The hot-stamping is expectable as a method forming an ultrahigh strength member, but there is a problem of scales generated at a heating time. The hot-stamping generally has a process of heating the steel sheet in the atmosphere, and at this time, oxides (scales) are generated on a steel sheet surface. A process of removing the scales is necessary because the generated scales cause lowering of adhesiveness of an electrodeposition coating film and post-coating corrosion resistance, and productivity of the member is lowered.

For example, Patent Document 1 proposes an art where generation of scales at the heating time is suppressed by using a Zn-based plated steel sheet as a steel sheet for hot-stamping as an art where the problem of the scales is improved and corrosion resistance of a hot-stamping formed product is increased.

However, since Zn used in the art proposed in Patent Document 1 is a metal having a low melting point, there is a case when the Zn-based plated steel sheet causes liquid metal embrittlement (LME) at the hot press-forming time when used for hot-stamping, resulting in a problem that collision resistance of an automotive member is lowered.

For example, in the following Patent Document 2 to Patent Document 4, there are proposed arts where the problem of scales is improved and the problem of the LME is solved by an Al-based plated steel sheet using Al being a metal having a relatively high melting point and excellent in oxidation resistance.

Prior Art Document

Patent Document

Patent Document 1: Japanese Laid-open Patent Publication No. H9-202953

Patent Document 2: Japanese Laid-open Patent Publication No. 2003-181549

Patent Document 3: Japanese Laid-open Patent Publication No. 2007-314874

Patent Document 4: Japanese Laid-open Patent Publication No. 2009-263692

DISCLOSURE OF THE INVENTION

Problems to Be Solved by the Invention

However, when the Al-based plated steel sheet proposed in each of Patent Document 2 to Patent Document 4 is used for the hot-stamping, Fe in the steel sheet diffuses up to a surface of the plating because the steel sheet is exposed to high temperature at 800° C. or more, resulting in that an Al plated layer changes into a Fe-Al-based plated layer formed by a hard and brittle Fe-Al-based intermetallic compound. Cracks and powdery peeling may thereby occur at the plated layer at the hot press forming time, and there is a possibility that formed part corrosion resistance is lowered. The Fe-Al-based plated layer described here means a plated layer where Fe diffuses for 40 mass % or more during the plating, and an Al content is 60 mass % or less.

Here, it is considered that the formed part corrosion resistance is lowered concretely due to a phenomenon where "red rust from a bent R-part of a formed part is rapidly generated by performing a phosphate conversion treatment and an electrodeposition coating treatment being general treatments and then corroded before it is used as an automotive component after being subjected to hot-stamping to have a hat-shape.

Since an Al oxide is formed on the Fe-Al-based plated layer, there is a possibility that reactivity with a treatment solution of the phosphate conversion treatment is inhibited to lower adhesiveness of the electrodeposition coating film after the electrodeposition coating treatment, and the post-coating corrosion resistance is lowered. Here, it can be thought that the post-coating corrosion resistance is lowered concretely due to a phenomenon where "corrosion blisters of a coating film from a flawed part are likely to spread by performing the phosphate conversion treatment and the electrodeposition coating treatment after the hot-stamping, and corroded after a flaw is applied with a cutter on the coating film (a flaw due to chipping or the like is simulated)".

Even when the arts proposed in Patent Document 2 to Patent Document 4 are used, there is still room for improvement regarding the formed part corrosion resistance and the post-coating corrosion resistance after the hot-stamping.

The present invention was made in consideration of the aforementioned problems, and an object thereof is to provide a Fe-Al-based plated hot-stamped member exhibiting more excellent formed part corrosion resistance and post-coating corrosion resistance and a manufacturing method of the Fe-Al-based plated hot-stamped member.

Means for Solving the Problems

As a result of hard studying to solve the aforementioned problems, the present inventors found that the formed part corrosion resistance was improved by accelerating reactivity of phosphate conversion and securing adhesiveness of an electrodeposition coating film by properly controlling Al, Fe compositions of a Fe-Al-based plated layer even when there are cracks and powdery peeling on plating at a forming time. Further, the present inventors found that spread of coating blisters due to corrosion from a flawed part could be suppressed by making an A layer, a B layer and a C layer being three layers located on a surface side of the Fe-Al-based plated layer contain Mn, Si, and by giving deviation among the A layer, the B layer and the C layer regarding compositions in regard to the corrosion of the flawed part of the electrodeposition coating film.

The gist of the present invention completed based on the aforementioned knowledge is as described below.

[1] A Fe-Al-based plated hot-stamped member, includes: a Fe-Al-based plated layer located on one surface or both surfaces of a base material, wherein the base material contains, in mass %, C: 0.1% or more and 0.5% or less, Si: 0.01% or more and 2.00% or less, Mn: 0.3% or more and 5.0% or less, P: 0.001% or more and 0.100% or less, S: 0.0001% or more and 0.100% or less, Al: 0.01% or more and 0.50% or less, Cr: 0.01% or more and 2.00% or less, B: 0.0002% or more and 0.0100% or less, and N: 0.001% or more and 0.010% or less, and the balance consisting of Fe and impurities, wherein the Fe-Al-based plated layer has a thickness of 10 μm or more and 60 μm or less, and formed by four layers of an A layer, a B layer, a C layer and a D layer sequentially from a surface toward the base material, each of the four layers is a Fe-Al-based intermetallic compound containing components listed below to be 100 mass % or less in total, with the balance consisting of impurities, and the D layer further contains Kirkendall voids whose cross-sectional area is 3 $\mu m^2$ or more and 30 $\mu m^2$ or less for 10 pieces/6000 $\mu m^2$ or more and 40 pieces/6000 $\mu m^2$ or less.

The A layer and the C layer

Al: 40 mass % or more and 60 mass % or less

Fe: 40 mass % or more and less than 60 mass %

Si: 5 mass % or less ("0" (zero) mass % is not included)

Mn: less than 0.5 mass % ("0" (zero) mass % is not included) and

Cr: less than 0.4 mass % ("0" (zero) mass % is not included)

The B layer

Al: 20 mass % or more and less than 40 mass %

Fe: 50 mass % or more and less than 80 mass %

Si: over 5 mass % and 15 mass % or less

Mn: 0.5 mass % or more and 10 mass % or less and

Cr: 0.4 mass % or more and 4 mass % or less

The D layer

Al: less than 20 mass % ("0" (zero) mass % is not included)

Fe: 60 mass % or more and less than 100 mass %

Si: 5 mass % or less ("0" (zero) mass % is not included)

Mn: 0.5 mass % or more and 2.0 mass % or less and

Cr: 0.4 mass % or more and 4 mass % or less

[2] The Fe-Al-based plated hot-stamped member according to [1], further includes: an oxide layer formed by Mg oxide and/or Ca oxide with a thickness of 0.1 μm or more and 3 μm or less at a surface of the A layer.

[3] The Fe-Al-based plated hot-stamped member according to [1] or [2], wherein the base material further contains, in mass %, at least any of W: 0.01 to 3.00%, Mo: 0.01 to 3.00%, V: 0.01 to 2.00%, Ti: 0.005 to 0.500%, Nb: 0.01 to 1.00%, Ni: 0.01 to 5.00%, Cu: 0.01 to 3.00%, Co: 0.01 to 3.00%, Sn: 0.005 to 0.300%, Sb: 0.005 to 0.100%, Ca: 0.0001 to 0.01%, Mg: 0.0001 to 0.01%, Zr: 0.0001 to 0.01%, and REM: 0.0001 to 0.01% instead of a part of Fe in the balance.

[4] A manufacturing method of a Fe-Al-based plated hot-stamped member, includes: subjecting a slab of steel having a base material component containing, in mass %, C: 0.1% or more and 0.5% or less, Si: 0.01% or more and 2.00% or less, Mn: 0.3% or more and 5.0% or less, P: 0.001% or more and 0.100% or less, S: 0.0001% or more and 0.100% or less, Al: 0.01% or more and 0.50% or less, Cr: 0.01% or more and 2.00% or less, B: 0.0002% or more and 0.0100% or less, and N: 0.001% or more and 0.010% or less, with the balance consisting of Fe and impurities, to hot-rolling, pickling, cold-rolling, and then after blanking a steel sheet which is continuously subjected to annealing and hot-dip aluminum plating, the steel sheet after blanking is heated at 850° C. or more and 1050° C. or less with a heating time of 150 seconds or more and 650 seconds or less, the heating time which is a time from putting the steel sheet after blanking into a heating facility to taking the steel sheet after blanking out, just after that, the steel sheet is formed into a desired shape and quenched at a cooling rate of 30° C./s or more, wherein a composition of a hot-dip aluminum plating bath used for the hot-dip aluminum plating contains: Al: 80 mass % or more and 96 mass % or less, Si: 3 mass % or more and 15 mass % or less, and Fe: 1 mass % or more and 5 mass % or less to be 100 mass % or less in total, with the balance consisting of impurities, and a steel sheet temperature Y (° C.) and a heating time X (seconds) in the heating are controlled such that: the heating time X where Y is 600° C. or more and 800° C. or less is 100 seconds or more and 300 seconds or less; and a point where a first derivative (dY/dX) of Y with respect to X becomes zero exists in a range where Y is 600° C. or more and 800° C. or less.

[5] The manufacturing method of the Fe-Al-based plated hot-stamped member according to [4], wherein the composition of the hot-dip aluminum plating bath further contains at least either Mg or Ca for 0.02 mass % or more and 3 mass % or less in total.

[6] The manufacturing method of the Fe-Al-based plated hot-stamped member according to [4] or [5], wherein the slab further contains, in mass %, at least any of W: 0.01 to 3.00%, Mo: 0.01 to 3.00%, V: 0.01 to 2.00%, Ti: 0.005 to 0.500%, Nb: 0.01 to 1.00%, Ni: 0.01 to 5.00%, Cu: 0.01 to 3.00%, Co: 0.01 to 3.00%, Sn: 0.005 to 0.300%, Sb: 0.005 to 0.100%, Ca: 0.0001 to 0.01%, Mg: 0.0001 to 0.01%, Zr: 0.0001 to 0.01%, and REM: 0.0001 to 0.01% instead of a part of Fe in the balance as the base material component.

Effect of the Invention

As mentioned above, according to the present invention, a Fe-Al-based plated hot-stamped member exhibiting more excellent formed part corrosion resistance and post-coating corrosion resistance and a manufacturing method of the Fe-Al-based plated hot-stamped member can be obtained.

EMBODIMENTS FOR CARRYING OUT THE INVENTION

Figure 1:
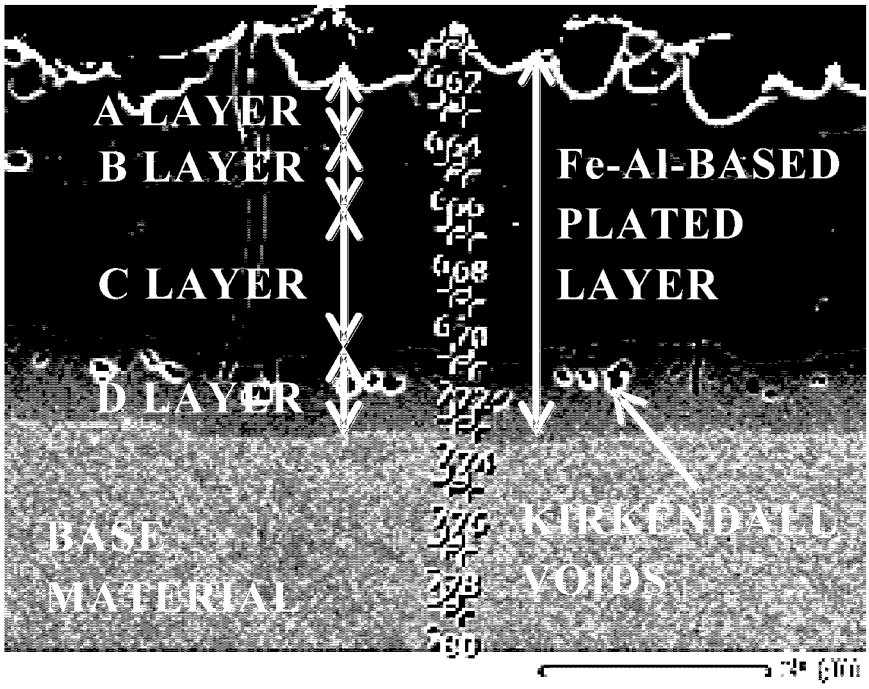
FIG. 1 is a cross-sectional observation photograph of a Fe-Al-based plating of a Fe-Al-based plated high-strength hot-stamped steel sheet of an example of the present application and is a diagram illustrating A to D layers in the Fe-Al-based plated layer, Kirkendall voids, and EDS analysis points of FIGS. 2, 3, 4.

Hereinafter, preferred embodiments of the present invention are explained with reference to the attached drawings.

<Regarding Fe-Al-based Plated High-Strength Hot-Stamped Member>

A Fe-Al-based plated high-strength hot-stamped member (hereinafter, it is also called just a "hot-stamped member") according to an embodiment of the present invention has a Fe-Al-based plated layer on one surface or both surfaces of a steel sheet being a base material. Vickers hardness (JIS Z 2244, load: 9.8 N) of the hot-stamped member according to the present embodiment is 300 HV or more. Hereinafter, the base material and the Fe-Al-based plated layer included by the hot-stamped member according to the present embodiment are explained in detail.

(Regarding Base Material)

First, base material components in the hot-stamped member according to the present embodiment are explained in detail. In the following explanation, % in each component means mass %.

Since hot-press forming with a metal die and hardening are simultaneously performed in the hot-stamping as previously explained, the base material of the hot-stamped member according to the present embodiment is necessary to be a high-hardenability component series.

The base material component of the hot-stamped member according to the present embodiment contains: in mass %, C: 0.1% or more and 0.5% or less, Si: 0.01% or more and 2.00% or less, Mn: 0.3% or more and 5.0% or less, P: 0.001% or more and 0.100% or less, S: 0.001% or more and 0.100% or less, Al: 0.01% or more and 0.50% or less, Cr: 0.01% or more and 2.00% or less, B: 0.0002% or more and 0.0100% or less, N: 0.001% or more and 0.010% or less, with the balance made up of Fe and impurities.

[C: 0.1% or More and 0.5% or Less]

The present invention provides a formed component (hot-stamped member) having high-strength with Vickers hardness of 300 HV or more after hot-stamping, and it is required to be transformed into a structure having martensite as a main body by quenching after the hot-stamping. A C (carbon) content is therefore necessary to be at least 0.1% or more in terms of improvement in hardenability. The C content is preferably 0.15% or more. Meanwhile, when the C content is too much, toughness and ductility of a steel sheet are remarkably lowered, and cracks occur at a hot-stamping forming time. Since the toughness and ductility are remarkably lowered when the C content is over 0.5%, the C content is set to 0.5% or less. The C content is preferably 0.40% or less.

[Si: 0.01% or More and 2.00% or Less]

Si (silicon) has an effect to diffuse in the plating due to heating at the hot-stamping time to improve corrosion resistance of the Fe-Al-based plated layer. Since the improvement in the corrosion resistance is exhibited when a Si content is 0.01% or more, the Si content is set to 0.01% or more. The Si content is preferably 0.05% or more, and more preferably 0.1% or more. Meanwhile, Si is an element which is easily oxidized (easily oxidizable element) than Fe. Accordingly, a stable Si-based oxide film is formed on a steel sheet surface during an annealing process in a continuous annealing and plating line, but when Si is excessively contained, plating deposition at a hot-dip Al plating process time is inhibited to cause unplating. The Si content is therefore set to 2.0% or less in terms of suppression of the unplating. The Si content is preferably 1.80% or less, and more preferably 1.50% or less.

[Mn: 0.3% or More and 5.0% or Less]

Mn (manganese) has an effect to diffuse in the plating due to heating at the hot-stamping time to improve corrosion resistance of the Fe-Al-based plated layer. Since the improvement effect of the corrosion resistance is exhibited when an Mn content is 0.3% or more, the Mn content is set to 0.3% or more. Further, hardenability of the base material can be increased and strength after the hot-stamping can be improved by setting the Mn content to 0.3% or more. The Mn content is preferably 0.5% or more, and more preferably 0.7% or more. Meanwhile, when Mn is excessively contained, impact properties of the member after hardening are lowered. Since the impact properties are lowered when the Mn content is over 5.0%, the Mn content is set to 5.0% or less. The Mn content is preferably 3.0% or less, and more preferably 2.5% or less.

[P: 0.001% or More and 0.100% or Less]

P (phosphorus) is an inevitably contained element, meanwhile, it is a solid-solution strengthening element, and strength of the steel sheet can be increased at relatively low cost. Since there is an adverse effect such that toughness is lowered when a P content is over 0.100%, the P content is set to 0.100% or less. The P content is preferably 0.050% or less. Meanwhile, a lower limit of the P content is not particularly limited, but it is not economical to make the P content less than 0.001% in terms of a refining limit The P content is therefore set to 0.001% or more. The P content is preferably 0.005% or more.

[S: 0.0001% or More and 0.100% or Less]

S (sulfur) is an inevitably contained element and reacts with Mn in steel to be an inclusion in steel as MnS. When an S content is over 0.100%, generated MnS becomes a starting point of breakage to inhibit ductility and toughness, and processability deteriorates. The S content is therefore set to 0.100% or less. The S content is preferably 0.010% or less. Meanwhile, a lower limit of the S content is not particularly limited, but it is not economical to make the S content less than 0.0001% in terms of refining limit. The S content is therefore set to 0.001% or more. The S content is preferably 0.0005% or more, and more preferably 0.001% or more.

[Al: 0.01% or More and 0.50% or less]

Al (aluminum) is contained in steel as deoxidizer. Al is an element which is easily oxidized (easily oxidizable element) than Fe. When an Al content is over 0.50%, a stable Al-based oxide film is formed on a steel sheet surface during the annealing process, and deposition properties of a hot-dip Al plating are inhibited to cause unplating. The Al content is therefore set to 0.50% or less in terms of suppression of the unplating. The Al content is preferably 0.30% or less. Meanwhile, a lower limit of the Al content is not particularly limited, but it is not economical to make the Al content less than 0.01% in terms of refining limit. The Al content is therefore set to 0.01% or more. The Al content is preferably 0.02% or more.

[Cr: 0.01% or More and 2.00% or Less]

Cr (chromium) has an effect to improve hardenability of the steel sheet similar to Mn. Since the improvement effect of the hardenability is exhibited when a Cr content is 0.01% or more, the Cr content is set to 0.01% or more. Further, Cr diffuses in the plating due to heating at the hot-stamping time and an effect to improve corrosion resistance of the Fe-Al-based plated layer is exhibited by setting the Cr content to 0.01% or more. The Cr content is preferably 0.05% or more, and more preferably 0.1% or more. Meanwhile, Cr is an element which is easily oxidized (easily oxidizable element) than Fe. When the Cr content is over 2.0%, a stable Cr-based oxide film is formed on a steel sheet surface during the annealing process to inhibit plating deposition at a hot-dip Al plating process time to cause unplating. The Cr content is therefore set to 2.0% or less in terms of suppression of unplating. The Cr content is preferably 1.00% or less.

[B: 0.0002% or More and 0.0100% or Less]

B (boron) is a useful element in terms of hardenability, and an improvement effect of the hardenability is exhibited by setting a B content to 0.0002% or more. The B content is therefore set to 0.0002% or more. The B content is preferably 0.0005% or more. Meanwhile, the improvement effect of the hardenability is saturated, casting defects and cracks at a hot-rolling time occur, or the like to cause lowering of manufacturability even when B is contained over 0.0100%. The B content is therefore set to 0.0100% or less. The B content is preferably 0.0050% or less.

[N: 0.001% or More and 0.010% or Less]

N (nitrogen) is an inevitably contained element and is desirably fixed in steel in terms of stabilization of properties. N can be fixed by Al and Ti, Nb, and so on which are selectively contained, but amounts of elements which are to be contained for fixing become large if an N content increases to cause cost increase. The N content is therefore set to 0.010% or less. The N content is preferably 0.008% or less. Meanwhile, though a lower limit of the N content is not particularly limited, it is not economical to make the N content less than 0.001% in terms of refining limit The N content is therefore set to 0.001% or more. The N content is preferably 0.002% or more.

Elements which can be selectively contained in the base material instead of Fe in the balance are explained below.

The base material according to the present embodiment may further contain, in mass %, at least any of W: 0.01 to 3.00%, Mo: 0.01 to 3.00%, V: 0.01 to 2.00%, Ti: 0.005 to 0.500%, Nb: 0.01 to 1.00%, Ni: 0.01 to 5.00%, Cu: 0.01 to 3.00%, Co: 0.01 to 3.00%, Sn: 0.005 to 0.300%, Sb: 0.005 to 0.100%, Ca: 0.0001 to 0.01%, Mg: 0.0001 to 0.01%, Zr: 0.0001 to 0.01%, REM: 0.0001 to 0.01% instead of a part of Fe in the balance.

[W, Mo: 0.01% or More and 3.00% or Less]

W (tungsten) and Mo (molybdenum) are each a useful element in terms of hardenability, and may be contained in terms of improvement in the hardenability. An improvement effect of the hardenability is exhibited when a content of each element is 0.01% or more. Each of the contents of W, Mo is therefore preferably set to 0.01% or more. Since the improvement effect of the hardenability is saturated and cost increases even when each element is contained over 3.00%, each of the contents of W, Mo is preferably set to 3.00% or less.

[V: 0.01% or More and 2.00% or Less]

V (vanadium) is a useful element in terms of hardenability, and may be contained in terms of improvement in the hardenability. An improvement effect of the hardenability is exhibited when a V content is 0.01% or more. Since the improvement effect of the hardenability is saturated and cost increases even when V is contained over 2.00%, the V content is preferably set to 2.00% or less.

[Ti: 0.005% or More and 0.500% or Less]

Ti (titanium) may be contained in terms of fixing N. When N is fixed by using Ti, Ti is necessary to be contained for about 3.4 times of the N content in mass %, but a lower limit of a Ti content may be set to, for example, 0.005% because the N content is approximately 10 ppm even when it is reduced. Meanwhile, when Ti is excessively contained, hardenability is lowered and strength is also lowered. Since the hardenability and the strength are remarkably lowered when the Ti content is over 0.500%, the Ti content is preferably set to 0.500% or less.

[Nb: 0.01% or More and 1.00% or Less]

Nb (niobium) may be contained in terms of fixing N. When N is fixed by using Nb, Nb is necessary to be contained for about 6.6 times of the N content in mass %, but a lower limit of an Nb content may be set to, for example, 0.01% because the N content is approximately 10 ppm even when it is reduced. Meanwhile, when Nb is excessively contained, hardenability is lowered and strength is also lowered. Since the hardenability and the strength are remarkably lowered when the Nb content is over 1.00%, the Nb content is preferably set to 1.00% or less.

The effects of the present invention are not inhibited even if Ni, Cu, Sn, Sb, and so on are contained as the base material component in addition to the aforementioned selective elements.

[Ni: 0.01% to 5.00%]

Ni (nickel) is a useful element in terms of low-temperature toughness which leads to improvement in impact resistance in addition to hardenability, and may be contained. Improvement effects of the hardenability and the low-temperature toughness are exhibited when an Ni content is 0.01% or more. The Ni content is therefore preferably set to 0.01% or more. Since the improvement effects are saturated and cost increases even when Ni is contained over 5.00%, the Ni content is preferably set to 5.00% or less.

[Cu: 0.01 to 3.00%, Co: 0.01 to 3.00%]

Cu (copper) and Co (cobalt) are each a useful element in terms of toughness in addition to hardenability as same as Ni, and may be contained. Improvement effects of the hardenability and the toughness are exhibited when each of contents of Cu, Co is 0.01% or more. Each of the contents of Cu, Co is therefore preferably set to 0.01% or more. Not only the improvement effects saturate and cost increases but also cast slab properties are deteriorated and cracks and flaws are generated at a hot-rolling time even when Cu, Co are each contained over 3.00%. The contents of Cu, Co are each therefore preferably set to 3.00% or less.

[Sn: 0.005% to 0.300%, Sb: 0.005% to 0.100%]

Sn (tin) and Sb (antimony) are each a useful element in terms of improvement in wettability and adhesiveness of plating, and may be contained. Improvement effects of the wettability and the adhesiveness of the plating are exhibited when a content of each element is 0.005% or more. Each of the contents of Sn, Sb is therefore preferably 0.005% or more. When Sn is contained over 0.300% or Sb is contained over 0.100%, flaws at a manufacturing time are likely to occur or lowering of toughness may occur. The Sn content is therefore preferably 0.300% or less and the Sb content is 0.100% or less.

[Ca: 0.0001 to 0.01%, Mg: 0.0001 to 0.01%, Zr: 0.0001 to 0.01%, REM: 0.0001 to 0.01%]

Ca (calcium), Mg (magnesium), Zr (zirconium), REM (rare earth metal: rare-earth element) each have an effect for miniaturization of inclusions by being contained for 0.0001% or more. Each of contents of Ca, Mg, Zr, REM is therefore preferably 0.0001% or more. Meanwhile, when the content of each element is over 0.01%, the aforementioned effect is saturated. Each of the contents of Ca, Mg, Zr, REM is therefore preferably 0.01% or less.

In the present embodiment, other components of the base material are not particularly defined. For example, there is a case when an element such as As (arsenic) is mixed in from scrap, but the properties of the base material are not affected if a content is within a normal range.

(Regarding Fe-Al-based Plated Layer)

Next, a Fe-Al-based plated layer which is the most important in the present invention is explained in detail.

A thickness of the Fe-Al-based plated layer according to the present embodiment is 10 μm or more and 60 μm is less. When the thickness of the Fe-Al-based plated layer is less than 10 μm, the formed part corrosion resistance and the post-coating corrosion resistance are lowered. Meanwhile, when the thickness of the Fe-Al-based plated layer is over 60 μm, shear force which is applied to the plating from a metal die at the hot-stamping forming time and stress at a compressive deformation time become large due to the thick plated layer to cause peeling of the plated layer, and the formed part corrosion resistance and the post-coating corrosion resistance are lowered. The thickness of the Fe-Al-based plated layer is preferably 15 pm or more, and more preferably 20 pm or more. The thickness of the Fe-Al-based plated layer is preferably 55 μm or less, and more preferably 50 μm or less.

The "Fe-Al-based plated layer" described here means a plated layer formed by a Fe-Al-based metallic compound and inevitably contained impurities. Concrete examples of the Fe-Al-based intermetallic compound include, for example, $Fe_2Al_5$, $FeAl_2$, FeAl (also called ordered BCC), α-Fe (also called disordered BCC) and Al solid solution a-Fe, ones where Si is solid-solved into these compositions, further, a ternary alloy composition of Al-Fe-Si, or the like (12 kinds of τ1 to τ12 are specified, and in particular, τ5 is also called an α-phase, and τ6 is also called a β-phase.) though there is a case when a detailed stoichiometric composition cannot be specified. Examples of the inevitable impurities contained in the Fe-Al-based plated layer include, for example, components such as stainless steel, ceramic, and a sprayed coating film to these materials which are generally used as a hot-dip plating facility at a hot-dip plating time. When Zn is contained in an Al plating bath, Zn contained in the Fe-Al-based plated layer is preferably 10 mass % or less, and more preferably 3 mass % or less for a reason of LME suppression at the hot-stamping time.

In the hot-stamped member according to the present embodiment, the Fe-Al-based plated layer is formed by four layers of an A layer, a B layer, a C layer, and a D layer sequentially from a surface toward the base material. A further lower layer of the D layer is the base material. These four layers can be specified to be distinguished because a contrast which is obtained after the plating is subjected to cross-sectional polishing without subsequently performing etching, observed from the cross-section with a scanning electron microscope (SEM), and photographed as a compositional image at 1000 magnifications (also called a reflected electron beam image) is divided into four kinds. An observation result of the cross-section of the Fe-Al-based plated layer according to the present invention is illustrated in FIG. 1 as an example.

In FIG. 1, first, a martensite structure is formed at the base material. In this diagram, it is not clear whether the structure is the martensite structure because etching is not performed, but it has high-hardness of HV 400 or more suggesting to be the martensite structure as a result of measurement of Vickers hardness (load of 9.8 N). Next, a light gray contrast layer adjacent to the base material is the D layer. A layer having a dark gray contrast, formed on a surface side than the D layer and adjacent to the D layer is the C layer. A light gray contrast layer on the surface side adjacent to the C layer is the B layer, and a dark gray layer on the most surface side adjacent to the B layer is the A layer. There is a case when the B layer becomes intermittent and the A layer and the C layer cannot be distinguished as another observation example, but such a case is included in a scope of the present invention, and there is no effect on the formed part corrosion resistance and the post-coating corrosion resistance. Dark and light of the contrast are an example, and a plated layer distinguished to be four layers is included in a four-layer structure within the scope of the present application.

Examples of a specification method of a composition of each of the A layer, the B layer, the C layer and the D layer forming the Fe-Al-based plated layer include, for example, the following methods. That is, a plating is subjected to cross-sectional polishing without subsequently performing etching, observed from the cross-section with an electron probe microanalyzer (EPMA) to have a compositional image at 1000 magnifications, to perform element analysis. The A layer, the B layer, the C layer and the D layer are specified and distinguished through the aforementioned method, then the compositions of the A layer, the B layer, the C layer and the D layer are respectively analyzed, and each composition can be found from a quantitative analysis result where a total content of Al, Fe, Si, Mn and Cr is set to 100%. In each layer, the chemical composition analysis is performed at two points or more, and an average value of the obtained analysis values is regarded a composition of the layer.

The composition of each of the A layer, the B layer, the C layer and the D layer is as follows. Note that "%" of the following composition is mass %, and each layer contains the components shown below such that a summed total becomes 100 mass % or less with the balance being impurities.

The A layer and the C layer

Al: 40 mass % or more and 60 mass % or less

Fe: 40 mass % or more and less than 60 mass %

Si: 5 mass % or less ("0" (zero) mass % is not included)

Mn: less than 0.5 mass % ("0" (zero) mass % is not included)

Cr: less than 0.4 mass % ("0" (zero) mass % is not included)

The B layer

Al: 20 mass % or more and less than 40 mass %

Fe: 50 mass % or more and less than 80 mass %

Si: over 5 mass % and 15 mass % or less

Mn: 0.5 mass % or more and 10 mass % or less

Cr: 0.4 mass % or more and 4 mass % or less

The D layer

Al: less than 20 mass % ("0" (zero) mass % is not included)

Fe: 60 mass % or more and less than 100 mass %

Si: 5 mass % or less ("0" (zero) mass % is not included)

Mn: 0.5 mass % or more and 2 mass % or less

Cr: 0.4 mass % or more and 4 mass % or less

A first role of the Fe-Al-based plated layer is to improve a possibility regarding the formed part corrosion resistance. As mentioned above, when the Al-based plated steel sheet is used for the hot-stamping, it is exposed to high-temperature of 800° C. or more, resulting in that Fe diffuses up to a surface of the plating, and the plated layer changes into a Fe-Al-based plated layer formed by a hard and brittle Fe-Al-based intermetallic compound. As a result, cracks and powdery peeling are generated on the plating at a hot press-forming time to lower the formed part corrosion resistance. The possibility regarding the formed part corrosion resistance is more concretely a possibility where red rust from a bent R-part of a formed part is rapidly generated when the Fe-Al-based plated layer is subjected to a phosphate conversion treatment and an electrodeposition coating treatment and then corroded after it is hot-stamped into a hat-shape.

The present inventors hardly studied regarding the possibility, and as a result, found that the red rust from the bent R-part of the formed part is caused by rust started from cracks which are generated by forming of the Fe-Al-based plated layer. Further, the present inventors found that it is important that each of the compositions of the A layer, the B layer, the C layer and the D layer of the Fe-Al-based plated layer contains Al: 60 mass % or less and Fe: 40 mass % or more, and further contains Si, Mn and Cr in order to suppress the generation of such rust.

Though the reason why the generation of the rust started from the cracks can be suppressed by the above-stated composition is not clear, it is estimated as described below. That is, it is estimated that reactivity of the phosphate conversion treatment rapidly improves by making the Fe-Al-based plated layer have the composition as stated above, resulting in that a dense coating film of phosphate conversion crystals is formed, the formed dense coating film acts as a barrier layer for corrosion to suppress the generation of the rust on the Fe-Al-based plated layer.

In general, since an inert aluminum oxide film generated by heating is formed on the surface of the Fe-Al-based plated layer which is subjected to the hot-stamping heating, the phosphate conversion crystals are difficult to be formed. However, at the bent R-part at the forming time, the aluminum oxide film is less formed and the phosphate conversion crystals are relatively likely to be formed because cracks are generated at the plating and the cracks are formed after the hot-stamping heating. As a result, it can be thought that the reactivity of the phosphate conversion treatment rapidly improves by controlling the composition to have the Fe-Al-based plated layer according to the present embodiment, and the corrosion of the cracks at the Fe-Al-based plated layer is thereby suppressed to improve the formed part corrosion resistance.

Accordingly, the phosphate conversion crystals are finely formed at the A layer, the B layer, the C layer and the D layer due to the cracks having the above-stated composition of the Fe-Al-based plating. The phosphate conversion crystal is a crystal formed by the phosphate conversion treatment which is general for an automotive component, and the crystal improves adhesiveness of electrodeposition coating after the conversion treatment and as a result, the crystal also improves the post-coating corrosion resistance. Rust progresses from a surface, but it is particularly important to control the compositions of the B layer, the C layer and the D layer also in addition to the A layer at the uppermost surface because the rust is started from cracks generated at the Fe-Al-based plated layer in terms of the formed part corrosion resistance.

By setting the composition of the Fe-Al-based plated layer to be Al: 60 mass % or less, Fe: 40 mass % or more, and further to contain Si, Mn and Cr as mentioned above, the reactivity of the phosphate conversion is accelerated. Though the cause thereof is still not clear, it is supposed that (1) the Al oxide formed at the hot-stamping time is made unstable to make the surface likely to be etched at the phosphate conversion treatment time which is generally acidic, (2) further, Si, Mn and Cr in the plating act as crystal nuclei of the phosphate conversion crystals to form a dense phosphate conversion crystal coating film, respectively affect thereon by suppressing Al to 60 mass % or less and increasing Fe to 40 mass % or more.

A second role of the Fe-Al-based plated layer is to improve a possibility regarding the post-coating corrosion resistance. As mentioned above, since the Al oxide is formed on the Fe-Al-based plated layer, there are possibilities that the reactivity with a treatment solution of the phosphate conversion treatment is inhibited, the electrodeposition coating film adhesiveness after the electrodeposition coating treatment is lowered, to lower the post-coating corrosion resistance. More concretely, the possibility regarding the post-coating corrosion resistance is a possibility where corrosion blisters of the coating film from a flawed part are likely to spread by performing the phosphate conversion treatment and the electrodeposition coating treatment after the hot-stamping, and the resultant is corroded after the flaw is applied to the coating film with a cutter (the flaw due to chipping or the like is simulated).

As a result of hard studies regarding the above-stated possibility, the present inventors found that the spread of the corrosion blisters of the coating film from the flawed part was caused by the lowering of the reactivity of the phosphate conversion treatment and the corrosion of the Fe-Al-based plated layer. The present inventors also found that it was important to suppress the corrosion of the Fe-Al-based plated layer by controlling the compositions of the A layer, the B layer, the C layer and the D layer into the aforementioned compositions in addition to improve the reactivity of the phosphate conversion treatment by setting the composition of the Fe-Al-based plated layer to have Al: 60 mass % or less, Fe: 40 mass % or more and to contain Si, Mn and Cr as same as the possibility regarding the formed part corrosion resistance in order to suppress the aforementioned causes.

The compositions of the A layer, the B layer, the C layer and the D layer described here are concretely as mentioned above. The composition of each of the A layer and the C layer is, in mass %, Al: 40% or more and 60% or less, Fe: 40% or more and less than 60%, Si: 5% or less ("0" (zero)% is not included), Mn: less than 0.5% ("0" (zero)% is not included), and Cr: less than 0.4% ("0" (zero)% is not included). The composition of the B layer is, in mass %, Al: 20% or more and less than 40%, Fe: 50% or more and less than 80%, Si: over 5% and 15% or less, Mn: 0.5% or more and 10% or less, and Cr: 0.4% or more and 4% or less. The composition of the D layer is, in mass %, Al: less than 20% ("0" (zero)% is not included), Fe: 60% or more and less than 100%, Si: 5% or less ("0" (zero)% is not included), Mn: 0.5% or more and 2% or less, and Cr: 0.4% or more and 4% or less.

Though the reason why the corrosion of the Fe-Al-based plated layer is suppressed by setting the compositions of the A layer, the B layer, the C layer and the D layer as stated above is not clear, it is estimated as follows. That is, it is estimated that the A layer and the C layer located on the surface side than the D layer are corroded at a relatively initial stage, further, corrosion products of the A layer and the C layer act as barrier layers for progress of the subsequent corrosion to suppress the corrosion blisters of the coating film at the flawed part. In particular, it is thought that the barrier layer which mostly suppresses the progress of the corrosion is obtained by sufficiently containing Al and suppressing to contain excessive Fe, Si, Mn. A concrete composition of each of the A layer and the C layer is, in mass %, Al: 40% or more and 60% or less, Fe: 40% or more and less than 60%, Si: 5% or less ("0" (zero)% is not included), Mn: less than 0.5% ("0" (zero)% is not included), Cr: less than 0.4% ("0" (zero)% is not included) in consideration of simultaneously satisfying the reactivity of the phosphate conversion as stated above.

Meanwhile, the B layer and the D layer each containing less Al with respect to the corrosion of the A layer and the C layer as mentioned above become electrochemically noble, and are difficult to be corroded compared to the A layer and the C layer. Though the B layer and the D layer are not located at the uppermost surface, the B layer and the D layer may be exposed as a result of cracks occurred at the plating at a formed crack part. phosphate conversion performance is therefore important in terms of the corrosion resistance, and it turned out that it was important to sufficiently contain Fe, Si, and Mn because the phosphate conversion crystals are likely to be formed.

A concrete composition of the D layer is, in mass %, Al: less than 20% ("0" (zero)% is not included), Fe: 60% or more and less than 100%, Si: 5% or less ("0" (zero)% is not included), Mn: 0.5% or more and 2% or less, and Cr: 0.4% or more and 4% or less in consideration of simultaneously satisfying the reactivity of the phosphate conversion as stated above. The B layer is set to have the Al, Fe compositions near the A layer and the C layer because the B layer is sandwiched between the A layer and the C layer, further Si and Mn are contained to thereby suppress the corrosion of the B layer due to a protective action of oxides of Si and Mn. A concrete composition of the B layer is, in mass %, Al: 20% or more and less than 40%, Fe: 50% or more and less than 80%, Si: over 5% and 15% or less, Mn: 0.5% or more and 10% or less, and Cr: 0.4% or more and 4% or less in consideration of simultaneously satisfying the reactivity of the phosphate conversion as stated above.

As mentioned above, an art according to the present embodiment was completed by providing the B layer and the D layer which are relatively difficult to be corroded and the A layer and the C layer which are likely to be corroded but can be expected to improve the corrosion resistance due to the generated corrosion products in the Fe-Al-based plated layer in order to (1) improve the conversion treatment performance of the cracks at the Fe-Al-based plated layer in order to improve the formed part corrosion resistance, and (2) improve the post-coating corrosion resistance.

[Regarding Number Density of Kirkendall Voids]

The D layer contains Kirkendall voids each with an area (cross-sectional area) of 3 $\mu m^2$ or more and 30 $\mu m^2$ or less at a number density of 10 pieces/6000 $\mu m^2$ or more and 40 pieces/6000 $\mu m^2$ or less. The formed part corrosion resistance is thereby more certainly improved. Stress concentration applied to the plating at the hot-stamping forming time is relieved by the Kirkendall voids existing in the D layer and the peeling of the plating is suppressed, resulting in that the formed part corrosion resistance is improved. The improvement effect cannot be obtained when the number density of the Kirkendall voids is less than 10 pieces/6000 $\mu m^2$. Menwhile, when the number density of the Kirkendall voids is over 40 pieces/6000 μm2, the Kirkendall voids may rather become starting points of the plating peeling at the hot-stamping forming time.

The number density of the Kirkendall voids is controlled as described below. That is, since the formation of the Kirkendall voids is resulting from the diffusion of Al and Fe, the number density of the Kirkendall voids increases due to increase in a maximum attained sheet temperature and a heating time of the steel sheet at the hot-stamping time. The number density of the Kirkendall voids can be controlled to be a desired value by setting $dY/dX=0$ which is described later being a slope of a temperature increasing rate changing with the passage of time during the temperature increase at the hot-stamping time when an alloying reaction occurs due to the diffusion of Fe into the plating.

As a specification method of the area (cross-sectional area) of the Kirkendall void described here, the four layers of the A layer, the B layer, the C layer and the D layer are specified and respectively distinguished through a method using the scanning electron microscope (SEM) described above. After that, the same visual field is photographed as the compositional image (it is also called the reflected electron beam image) at the 1000 magnifications, and black contrast parts existing in the D layer in the obtained compositional image can be specified as the Kirkendall voids. The Kirkendall void is dented because it is a void of the plating, and the reflected electron beam is difficult to be detected from the dent part due to steric hindrance, so the Kirkendall void is observed to be black as the contrast in the compositional image. At this time, a longest major axis and a shortest minor axis of an ellipse surrounding a grain which is observed to be black are measured, a half of an average value of the obtained major axis and the minor axis is treated as a radius r, and a value given by $\pi r^2$ is regarded as a size of the area (cross-sectional area) of the Kirkendall void. Most of the Kirkendall voids have circular or elliptical shapes, but a plurality of Kirkendall voids are sometimes in contact with each other in a growth process to have an indeterminate shape. A major axis and a minor axis in this case can be defined that a diameter of a minimum circumscribed circle which is circumscribed with the indeterminate-shaped Kirkendall void is set as the major axis, and a diameter of a maximum inscribed circle which is inscribed with the indeterminate-shaped Kirkendall void is set as the minor axis.

Figure 5:
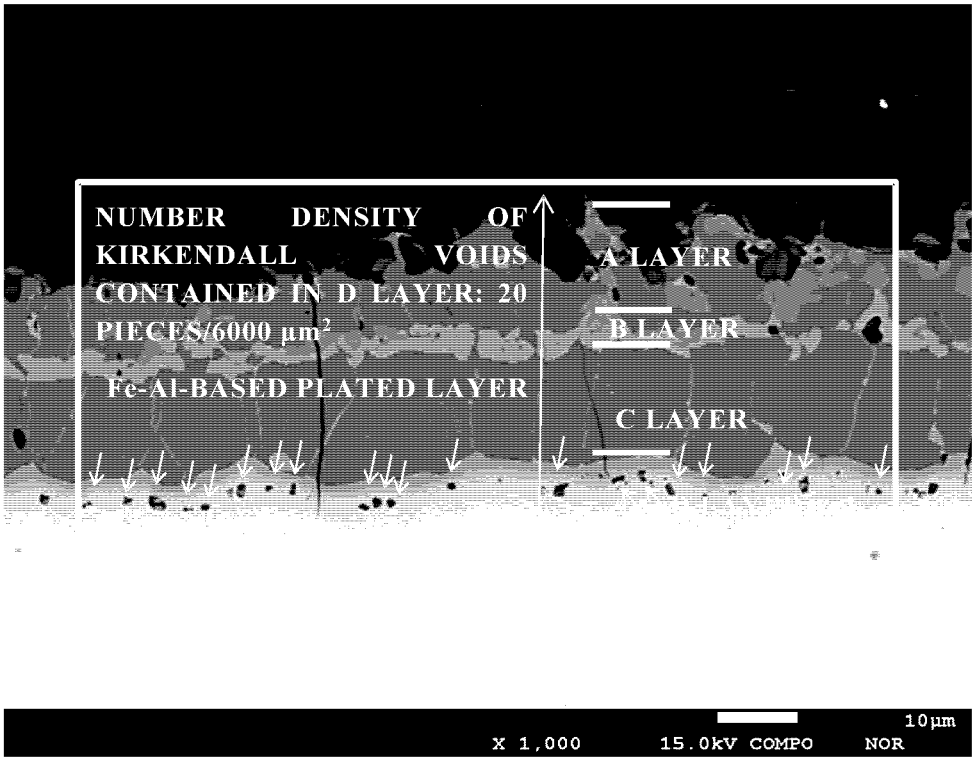
FIG. 5 is a plated cross-section of the example of the present application and illustrates a measuring method of a number density of Kirkendall voids and measurement results thereof

In a viewing field at 1000 magnifications, the Fe-Al-based plated layer is surrounded by a rectangle with a thickness of 60 μm×a length of 100 jam, and a result of counting the number of Kirkendall voids in the D layer included in the rectangle region is set as a number density of the Kirkendall voids (pieces/6000 $\mu m^2$). In Examples shown below, FIG. 5 illustrates an example where the number density of the Kirkendall voids contained in the D layer is found.

[Regarding Oxide Layer]

Further, it is more preferable that an oxide layer formed by Mg oxide and/or Ca oxide is selectively held on a surface of the A layer with a thickness of 0.1 μm or more and 3 pm or less in terms of improvement in the formed part corrosion resistance and the post-coating corrosion resistance. The oxide layer formed by the Mg oxide and/or the Ca oxide is formed on the surface of the A layer, resulting in that lubricity at the hot-stamping forming time improves, damages of the plating are suppressed, and formation of the conversion coating film is accelerated, as a result, the formed part corrosion resistance and the post-coating corrosion resistance are improved. When the thickness of the oxide layer is less than 0.1 μm, the above-stated effect cannot be obtained, and when the thickness of the oxide film is over 3 μm, adhesiveness of the oxide layer is lowered and causes peeling of a subsequently formed electrodeposition coating film.

The oxide layer formed by the Mg oxide and/or the Ca oxide described here is distinguished from the A layer, and is a layer containing 10 mass % or more of Mg and Ca in total. In the A layer, the total content of Mg and Ca is less than 10 mass %. An example of a specification method of the thickness and the composition of the oxide layer formed by the Mg oxide and/or the Ca oxide includes a method where the plating is subjected to cross-sectional polishing without subsequently performing etching, the obtained cross-section is observed by EPMA, elemental analysis is continuously performed on a line perpendicular to the surface similarly to the above, and the thickness and the composition are found from the thickness where 10 mass % or more of Mg and/or Ca in total is contained.

[Regarding Other Coating Film Layer Which Can Be Included by Hot-Stamped Member]

Regarding the Fe-Al-based plated hot-stamped member according to the present embodiment, the base material and the Fe-Al-based plated layer are as mentioned above, but the hot-stamped member becomes a final product after subsequently passing through various processes such as welding, a conversion treatment, and electrodeposition coating when it is used as an automotive component.

Normally, a phosphate conversion treatment (a conversion treatment of which main components are phosphorus and zinc) or a zirconium-based conversion treatment (a conversion treatment whose main component is zirconium) is performed as the conversion treatment, and a conversion treatment coating film in accordance with the conversion treatment is further formed on a surface of the hot-stamped member according to the present embodiment. Normally, cation electrodeposition coating (C is a main component) is often performed as the electrodeposition coating for a film thickness of approximately 1 to 50 μm, and coatings such as intermediate coating and finish coating are sometimes performed after the electrodeposition coating. Coating film layers formed by these treatments and the A layer, the B layer, the C layer and the D layer of the Fe-Al-based plated layer can be easily specified and distinguished based on difference in main components, and the layer containing Fe for 40 mass % or more is regarded as the Fe-Al-based plated layer.

Hereinabove, the Fe-Al-based plated hot-stamped member according to the present embodiment is explained in detail.

<Regarding Manufacturing Method of Fe-Al-based Plated Hot-Stamped Member>

Next, a manufacturing method of the Fe-Al-based plated hot-stamped member according to the present embodiment is described.

In the manufacturing method of the Fe-Al-based plated hot-stamped member according to the present embodiment, after adjusting a chemical component in a steelmaking process so as to satisfy the chemical composition described above, a slab (base material) is manufactured by performing continuous casting, and then, the obtained slab (base material) is subjected to hot-rolling, pickling, and cold-rolling to have a cold-rolled steel sheet, and the obtained cold-rolled steel sheet is subjected to recrystallization annealing, a hot-dip aluminum plating process continuously in a hot-dip plating line to have an Al-based plated steel sheet, and the obtained Al plated steel sheet is subjected to heating, forming, and quenching continuously at a hot-stamping facility after blanking to manufacture the Fe-Al-based plated hot-stamped member according to the present embodiment. Hereinafter, the manufacturing method of the Fe-Al-based plated hot-stamped member according to the present embodiment is explained in detail.

(Regarding Manufacture of Al-Plated Steel Sheet)

In the present embodiment, regarding processes until the Al-plated steel sheet is obtained, hot-rolling is not particularly limited. For example, hot-rolling may be started at a heating temperature of 1300° C. or less (for example, in a range of 1000 to 1300° C.), the hot-rolling may be finished at around 900° C. (for example, in a range of 850 to 950° C.), and a rolling ratio may be set in a range of 60 to 90%.

A coiling temperature of the steel sheet after the hot-rolling as stated above is not also particularly limited, and for example, it may be set in a range of 700° C. or more and 850° C. or less.

A condition of the pickling of the steel sheet after the hot-rolling is not particularly limited, and for example, it may be hydrochloric acid pickling or sulfuric acid pickling.

Further, a condition of the cold-rolling performed after the pickling is not particularly limited, and for example, a rolling ratio may be appropriately selected in a range of 30 to 90%.

After a cold-rolled steel sheet is obtained through the aforementioned processes, the obtained cold-rolled steel sheet is subjected to recrystallization annealing, a hot-dip aluminum plating process continuously in a hot-dip plating line to have an Al-plated steel sheet. In the present embodiment, the hot-dip aluminum plating is performed by immersing into a hot-dip aluminum plating bath, and controlling an aluminum plating deposition amount by wiping treatment. A composition of the hot-dip aluminum plating bath contains, in mass %, Al: 80% or more and 96% or less, Si: 3% or more and 15% or less, Fe: 1% or more and 5% or less such that a total amount becomes 100 mass % or less, with the balance made up of impurities.

Al is an element required for improvement in oxidation resistance and corrosion resistance at a heating time of hot-stamping, and when an Al content is less than 80 mass %, the corrosion resistance of the plating is deteriorated, and when the Al content is over 96 mass %, the plating is likely to be peeled off at the hot-stamping forming time, and the corrosion resistance is deteriorated. The Al content in the hot-dip aluminum plating bath is preferably 82 mass % or more. The Al content in the hot-dip aluminum plating bath is preferably 94 mass % or less.

Si is an element required for improvement in corrosion resistance of the Fe-Al-based plating after the hot-stamping, and when a Si content is less than 3 mass %, the corrosion resistance of the plating is deteriorated, and when the Si content is over 15 mass %, unplating occurs after the hot-dip plating process. The Si content in the hot-dip aluminum plating bath is preferably 5 mass % or more. The Si content in the hot-dip aluminum plating bath is preferably 12 mass % or less.

Though Fe in the hot-dip aluminum plating bath is inevitably contained due to elution of Fe when the steel sheet is immersed therein, it is an element required to accelerate an amount of Fe contained in the Fe-Al-based plating. When the Fe content is less than 1 mass %, the corrosion resistance of the plating is deteriorated, and when the Fe content is over 5 mass %, a lot of dross is formed in the hot-dip aluminum plating bath to cause generation of pressed flaws at a press-forming time and an appearance grade is damaged. The Fe content in the hot-dip aluminum plating bath is preferably 2 mass % or more. The Fe content in the hot-dip aluminum plating bath is preferably 4 mass % or less.

It is preferable that Mg and/or Ca is contained for 0.02 mass % or more and 3 mass % or less in total in the hot-dip aluminum plating bath in terms of improving the corrosion resistance of the Fe-Al-based plating. When a total content of Mg and Ca is less than 0.02 mass %, an improvement effect of the corrosion resistance cannot be obtained. Meanwhile, when the total content of Mg and Ca is over 3 mass %, a problem of unplating occurs at the hot-dip plating process time due to generated excessive oxides. The total content of Mg and Ca in the hot-dip aluminum plating bath is preferably 0.05 mass % or more and 2 mass % or less. The total content of Mg and Ca in the hot-dip aluminum plating bath is more preferably 0.1 mass % or more. The total content of Mg and Ca in the hot-dip aluminum plating bath is more preferably 1 mass % or less.

By containing Mg and/or Ca for 0.02 mass % or more and 3 mass % or less in total in the hot-dip aluminum plating bath, the plated layer before hot-stamping is able to contain Mg and/or Ca for 0.02 mass % or more and 3 mass % or less in total. Since Mg and Ca are elements which are very likely to be oxidized, Mg and/or Ca forms an oxide film at the surface of the A layer of the Fe-Al-based plated layer, and seldom remains in the Fe-Al-based plating after the hot-stamping. The oxide film formed as stated above becomes the above-described oxide layer formed by Mg oxide and/or Ca oxide.

A film thickness of the oxide film formed after the hot-stamping can be controlled as described below. That is, the oxide film of Mg and/or Ca is formed by Mg and/or Ca contained in the hot-dip plating bath being diffused at a plating surface due to the heating at the hot-stamping time to be oxidized. It is therefore possible to increase a film thickness of the oxide film after the hot-stamping by increasing the contents of Mg, Ca in the plating bath. Though the film thickness of the oxide film after the hot-stamping can be increased as the heating time at the hot-stamping time is longer and as the maximum attained sheet temperature is higher, there is a tendency that an increase margin is saturated in accordance with the contents of Mg, Ca in the hot-dip plating bath.

Though a condition of the wiping treatment is not particularly limited, it is preferable that a deposition amount of aluminum plating is controlled to be 30 g/m$^2$ or more and 120 g/m$^2$ or less per one surface to form an aluminum-based plated layer. When the deposition amount of the aluminum plating is less than 30 g/m$^2$ per one surface, there is a case when the corrosion resistance after the hot-stamping becomes insufficient. Meanwhile, when the deposition amount of the aluminum plating is over 120 g/m$^2$ per one surface, there is a case when a problem that the plating is peeled off at the hot-stamping forming time. The deposition amount of the aluminum plating per one surface is more preferably 40 g/m$^2$ or more. The deposition amount of the aluminum plating per one surface is more preferably 100 g/m$^2$ or less.

An example of a specification method of the deposition amount of the aluminum plating includes, for example, a sodium hydroxide-hexamethylenetetramine•hydrochloric acid removal gravimetric method. Concretely, a test piece with a predetermined area S (m$^2$) (for example, 50 mm×50 mm) is prepared, and a weight $w_1$ (g) is measured as described in JIS G 3314: 2011. After that, the test piece is sequentially immersed in an aqueous sodium hydroxide solution, an aqueous hydrochloric acid solution where hexamethylenetetramine is added until foaming calms down, then the test piece is immediately water-washed, and a weight $w_2$ (g) is measured again. At this time, a deposition amount (g/m$^2$) of aluminum plating at both surfaces of the test piece can be found by an expression: $(w_1-w_2)/S$.

(Regarding Manufacture of Hot-Stamped Member)

A steel sheet where aluminum plating is deposited (Al plated steel sheet) obtained as mentioned above is subjected to heating, forming, and quenching continuously in a hot-stamping facility after blanking Fe thereby diffuses up to a surface of the aluminum plating at the heating time, and a Fe-Al-based plated high-strength hot-stamped member is manufactured. Here, a heating method is not particularly limited, and heating methods such as furnace heating using radiant heat, a near-infrared ray method, a far-infrared ray method, induced heating or energization heating can be used.

Here, when the hot-stamped member according to the present embodiment is manufactured, a time from the Al-plated steel sheet after blanking is put into a heating facility such as the above-stated heating furnace until it is taken out is called a heating time. Note that a convey time after the Al-plated steel sheet is taken out of the heating facility and a hot forming time as described below are not included in the heating time. In the present embodiment, the heating time is controlled to be 150 seconds or more and 650 seconds or less. When the heating time from the Al-plated steel sheet after blanking is put into the heating facility until it is taken out is less than 150 seconds, it is not preferable because the diffusion of Fe into the Al plating becomes insufficient to cause that soft Al remains in the Al plating, and the formed part corrosion resistance and the post-coating corrosion resistance are deteriorated. Meanwhile, when the heating time is over 650 seconds, it is not preferable because the diffusion of Fe into the Al plating excessively proceeds, and not only the four-layer structure cannot be kept but also corrosion due to Fe becomes remarkable. The heating time from the Al-plated steel sheet after blanking is put into the heating facility until it is taken out is preferably 200 seconds or more, and more preferably 250 seconds or more. The heating time from the Al-plated steel sheet after blanking is put into the heating facility until it is taken out is preferably 600 seconds or less, and more preferably 550 seconds or less.

In the heating process, a maximum attained sheet temperature of the Al-plated steel sheet is set to 850° C. or more and 1050° C. or less. A reason why the maximum attained sheet temperature is set to 850° C. or more is because martensite transformation is caused at the subsequent quenching time using a metal die by heating to an Acl point of the steel sheet or more, to make the base material high-strength and make Fe sufficiently diffuse up to the plating surface to proceed alloying of the Al-plated layer. The maximum attained sheet temperature of the Al-plated steel sheet is more preferably 910° C. or more. Meanwhile, when the maximum attained sheet temperature is over 1050° C., Fe excessively diffuses in the Fe-Al-based plating, and the post-coating corrosion resistance and the formed part corrosion resistance are deteriorated. The maximum attained sheet temperature of the Al-plated steel sheet is more preferably 980° C. or less.

Next, the heated Al-plated steel sheet is subjected to a hot-stamping forming into a predetermined shape between a pair of upper and lower forming metal die. The steel sheet is quenched by contact cooling with the forming metal die to be hardened by stationary holding at a press bottom dead center for several seconds after forming, and a high-strength member which is hot-stamping formed according to the present embodiment can be obtained. By setting an average cooling rate at the quenching time to 30° C./s or more, the martensite transformation can be sufficiently proceeded to make the base material high-strength. In the present embodiment, the Vickers hardness (load of 9.8 N) of the base material becomes 300 HV or more by the quench-hardening as stated above. An upper limit of the average cooling rate at the quenching time is not particularly limited, and the faster it is, the better, but approximately 1000° C./s is substantially the upper limit. Here, the average cooling rate (° C./s) can be found by measuring a time $t_0$ (s) required until a steel sheet temperature is quenched from 800° C. to 200° C. or less by using, for example, a thermocouple or a radiation thermometer, as an expression: $(800-200)/t_0$ from the obtained time $t_0$ (s).

Here, a steel sheet temperature Y (° C.) and a heating time X (s) in the heating are controlled such that the heating time X when the steel sheet temperature Y is in a range of 600° C. or more and 800° C. or less is 100 seconds or more and 300 seconds or less. The diffusion of Fe into the plating is controlled, and the Al-plated steel sheet changes into the hot-stamped member excellent in the formed part corrosion resistance and the post-coating corrosion resistance by setting the heating time X of the steel sheet and the steel sheet temperature Y in the above-stated ranges. When the steel sheet temperature Y is less than 600° C. or over 800° C., the formed part corrosion resistance and the post-coating corrosion resistance are lowered. When the heating time X is less than 100 seconds or over 300 seconds, the formed part corrosion resistance and the post-coating corrosion resistance are lowered. Regarding the heating at the hot-stamping time, the heating time X when the steel sheet temperature Y is 600° C. or more and 800° C. or less is preferably 120 seconds or more, and more preferably 150 seconds or more. The heating time X when the steel sheet temperature Y is 600° C. or more and 800° C. or less is preferably 280 seconds or less, and more preferably 250 seconds or less.

Regarding the steel sheet temperature Y in the heating, the steel sheet temperature Y is controlled such that a point where a first derivative (dY/dX) of the steel sheet temperature Y with respect to the heating time X becomes "0" (zero) exists in the range of 600° C. or more and 800° C. or less. When the first derivative (dY/dX) becomes zero, an extreme value exists in a temporal transition of the steel sheet temperature Y, and the time when the steel sheet temperature is in the temperature range of 600° C. or more and 800° C. or less which is important for the diffusion of Fe into the plating becomes long, and the diffusion state of Fe can be more certainly controlled. Here, the time when the steel sheet temperature is in the range of 600° C. or more and 800° C. or less is just not important in order to enable "the more certain control". A change in a phase structure of the plating due to the diffusion of elements such as Fe, Al, Si, Mn, Cr and further chemical compositions of the A layer, the B layer, the C layer and the D layer change with time. Accordingly, it is the most important to enable the state where the first derivative (dY/dX) becomes zero in order to control the phase structure and the compositions. The above-described thickening of Mn and thickening of Cr in the B layer and the D layer are thereby more certainly enabled. This effect can be obtained when the point where the first derivative (dY/dX) becomes zero exists in the range of the steel sheet temperature Y of 600° C. or more and 800° C. or less.

Though there are some unclear points regarding a mechanism where the compositions of the A layer, the B layer, the C layer and the D layer as mentioned above are obtained by performing the heat treatment according to the heat treatment conditions as stated above, it is estimated that a phenomenon explained below occurs. That is, Mn and Cr derived from the steel sheet diffuse into the plated layer in addition to Fe by performing the heat treatment according to the heat treatment conditions. The A layer to the D layer are formed after Mn and Cr derived from the steel sheet once diffuse to the surface of the plated layer during the heat treatment. Here, in the process when the A layer and the C layer are formed, Mn and Cr which are elements difficult to be contained in the A layer and the C layer are discharged from the A layer and C layer toward outside of the layers during forming to be thickened into the B layer and D layer during forming Accordingly, the contents of Mn and Cr contained in the B layer and the D layer are sometimes larger than the contents of Mn and Cr in the steel sheet. Since such a diffusion phenomenon occurs in the range of 600 to 800° C., it is necessary to control the first derivative (dY/dX) in addition to the heating time of the material at 600 to 800° C. in order to control the diffusion of the elements. Finally, it is estimated that the compositions of the A layer to the D layer as explained above are obtained at a stage of the Fe-Al-based plated hot-stamped member where the heating is finished.

When the steel sheet temperature Y is in the range of 600° C. or more and 800° C. or less, the number of times where the first derivative (dY/dX) becomes "0" (zero) is not particularly limited. For example, when the temperature is kept constant at 700° C., the number of times where the first derivative (dY/dX) becomes "0" (zero) is one time. As another example, the number of times where the first derivative (dY/dX) becomes "0" (zero) is two times if a method is adopted where the steel sheet is heated in a furnace at 900° C., then moved to a heating furnace at 600° C. just after the temperature reaches 700° C. in a middle of temperature increase, the steel sheet is held until the sheet temperature becomes 600° C., and then further heated in the furnace at 900° C. The number of times where the first derivative (dY/dX) becomes "0" (zero) is not particularly limited as long as it is one time or more, but it is preferably three times or less from reasons that a manufacturing facility becomes complicated and cost increases.

The steel sheet temperature Y in the heating is found by spot welding a K-type thermocouple to the steel sheet of 300 mm×300 mm and measuring the steel sheet temperature during heating. The steel sheet temperature at this time is sampled at a time interval of one second to be digitalized. The first derivative (dY/dX) of the steel sheet temperature Y can be found by measuring the steel sheet temperature at an interval of 0.1 second, the steel sheet temperature at a certain time is set as Y 1, and the steel sheet temperature after 0.1 second has passed is set as Y2, by an expression: (Y2−Y1)/0.1.

(Regarding Posttreatment After Hot-Stamping)

The hot-stamped member becomes a final component by passing through posttreatment such as welding, conversion treatment, and electrodeposition coating. As the conversion treatment, normally a zinc phosphate-based coating film or a zirconium-based coating film is supplied. As the electrodeposition coating, normally cation electrodeposition coating is often used, and a film thickness is about 5 to 50 μm. After the electrodeposition coating, coating such as intermediate coating and finish coating are sometimes further performed to improve an appearance grade and corrosion resistance.

Hereinabove, the manufacturing method of the Fe-Al-based plated hot-stamped member according to the present embodiment was explained in detail.

EXAMPLES

Hereinafter, the Fe-Al-based plated hot-stamped member according to the present invention and the manufacturing method thereof are explained more concretely by using Examples. Examples illustrated below are just examples of the Fe-Al-based plated hot-stamped member according to the present invention and the manufacturing method thereof, and the Fe-Al-based plated hot-stamped member according to the present invention and the manufacturing method thereof are not limited to the following Examples.

Example 1

Cold-rolled steel sheets (sheet thickness of 1.4 mm) having steel components listed in Table 1 were used as sample materials, these are each subjected to a hot-rolling process and a cold-rolling process, and further recrystallization annealing and a hot-dip aluminum plating process were continuously performed. In Table 1, mass ratios of Al, Fe, and Si whose contents were relatively large were each displayed in integer format by rounding-off, and a coiling temperature at a hot-rolling time was set to 700° C. or more and 800° C. or less, hot-dip Al plating was performed by using a non-oxidizing furnace-reduction furnace type line, a plating deposition amount was adjusted to be about 30 g/m$^2$ or more and 120 g/m$^2$ or less per one surface through a gas wiping method after the plating, and then cooled. An aluminum plating bath composition at this time was Al-2% Fe, and Si was 3% or more and 15%. The obtained Al-plated steel sheet was subjected to blanking into 240 mm×300 mm, formed into a hat-shape at a bent R =5 mm under conditions listed in Table 2-1, Table 2-2, then quenched at a cooling rate of 50° C./s or more, and a holding time at a bottom dead center was set to 10 seconds to obtain a high-strength hot-stamped member.

Here, heat treatment conditions A to F in Table 2-1, Table 2-2 are the conditions described as follows.

A: the state of dY/dX =0 exists, the heating time: 500 seconds, the maximum attained sheet temperature: 950° C., the heating time X in the range of 600° C. or more and 800° C. or less: 200 seconds B: dY/dX 0 (monotonous temperature increase), the heating time: 500 seconds, the maximum attained sheet temperature: 950° C., the heating time X to be 600° C. or more and 800° C. or less: 60 seconds C: dY/dX 0 (monotonous temperature increase), the heating time: 300 seconds, the maximum attained sheet temperature: 850° C., the heating time X in the range of 600° C. or more and 800° C. or less: 150 seconds D: dY/dX 0 (monotonous temperature increase), the heating time: 100 seconds, the maximum attained sheet temperature: 700° C., the heating time X in the range of 600° C. or more and 800° C. or less: 30 seconds E: the state of dY/dX =0 exists, the heating time: 700 seconds, the maximum attained sheet temperature: 1100° C., the heating time X in the range of 600° C. or more and 800° C. or less: 400 seconds F: the state of dY/dX =0 exists, the heating time: 300 seconds, the maximum attained sheet temperature: 650° C., the heating time X in the range of 600° C. or more and 800° C. or less: 100 seconds A K-type thermocouple was spot-welded to each Al-plated steel sheet which was blanked into 240 mm×300 mm, and the steel sheet temperature during heating was measured previously. As a result of actual measurement of the steel sheet temperature Y during the hot-stamping heating, each heating time X when the steel sheet temperature Y was in the range of 600° C. or more and 800° C. or less was as listed in Table 2-1, Table 2-2.

Figure 2:
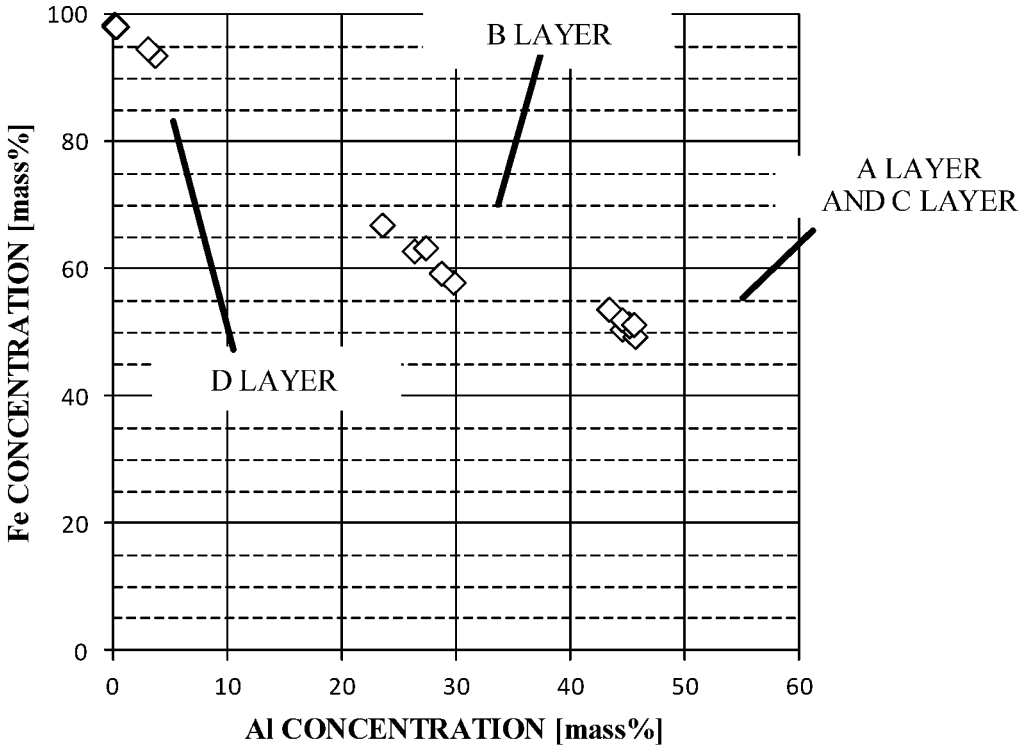
FIG. 2 is a diagram illustrating Al, Fe compositions of the Fe-Al-based plating found from EDS analysis of the plating of the Fe-Al-based plated hot-stamped steel sheet of the example of the present application. Gray hatched areas indicate ranges within scopes of the present invention.
Figure 3:
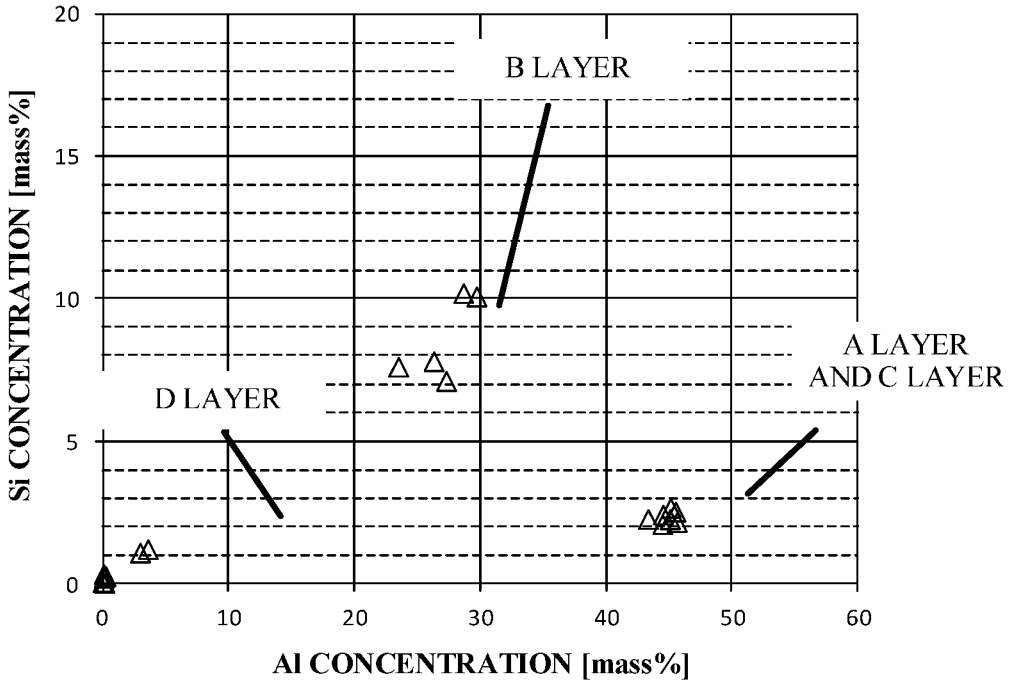
FIG. 3 is a diagram illustrating Al, Si compositions of the Fe-Al-based plating found from the EDS analysis of the plating of the Fe-Al-based plated hot-stamped steel sheet of the example of the present application. Gray hatched areas indicate ranges within scopes of the present invention.
Figure 4:
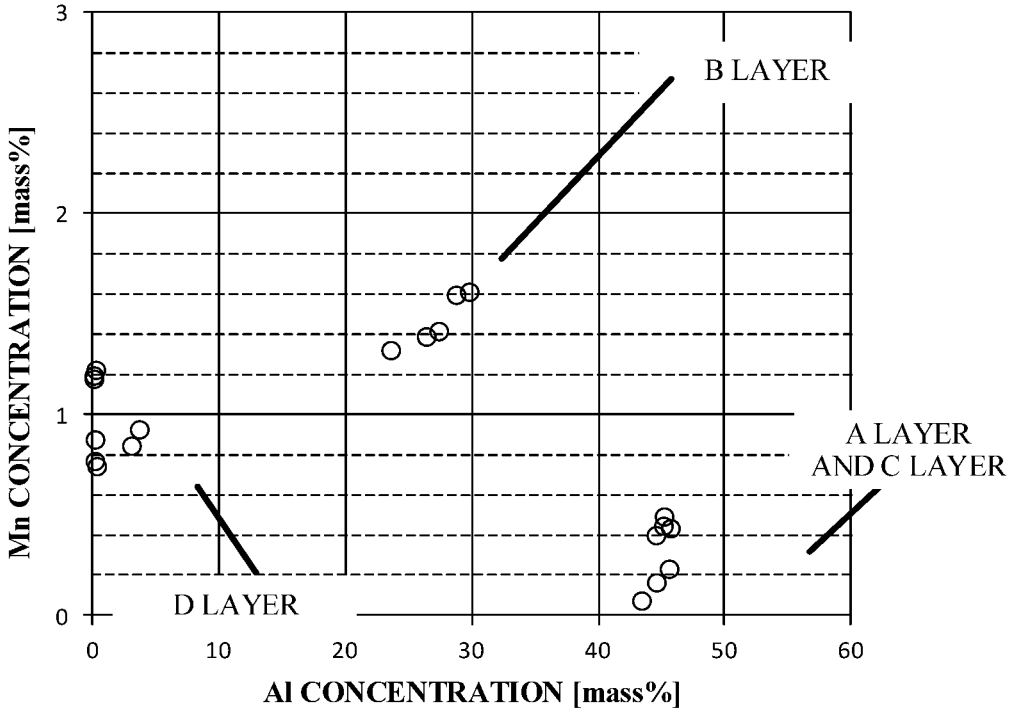
FIG. 4 is a diagram illustrating Al, Mn compositions of the Fe-Al-based plating found from the EDS analysis of the plating of the Fe-Al-based plated hot-stamped steel sheet of the example of the present application. Gray hatched areas indicate ranges within scopes of the present invention.

Regarding each of the hot-stamped members manufactured by using the base materials listed in Table 1 while changing various conditions, a thickness of a Fe-Al-based plated layer and compositions of an A layer, a B layer, a C layer and a D layer were specified by analyzing through EPMA according to the aforementioned method. The number of Kirkendall voids each having a cross-sectional area of 3 μm$^2$ or more and 30 μm$^2$ or less in the D layer was measured according to the method explained above. As a specifying example of the hot-stamped member corresponding to Example, FIGS. 2, 3, 4 illustrate results of analyzation of "+" marked points from a cross-sectional image illustrated in FIG. 1. The compositions of the A layer, the B layer, the C layer and the D layer are collectively listed in Table 2-1. Since each of samples of No. 20 to No. 22 listed in Table 2-2 did not have a four-layer structure of the A layer, the B layer, the C layer and the D layer which are focused attention in the present invention, detailed composition of each layer was not specified.

The formed part corrosion resistance and the post-coating corrosion resistance were evaluated according to the following references regarding each hot-stamped member.

The formed part corrosion resistance was evaluated through the following procedure.

Each of hat formed products with a bent-R=5 mm being the hot-stamped members manufactured by the aforementioned procedure was subjected to a conversion treatment by using a conversion treatment solution PB-SX35T manufactured by Nihon Parkerizing Co., Ltd., and then a cation electrodeposition coating material Powernics 110 manufactured by Nippon Paint Co., Ltd. was coated with a thickness of approximately 10 μm. After that, a combined corrosion test (JASO M610-92) defined by Society of Automotive Engineers of Japan was performed for 60 cycles (20 days), and presence/absence of generation of red rust at the R-part of the formed product was checked. A case when the red rust existed at the formed product was rated as "VB (very bad)", and similarly, a case when the red rust existed at a stage of 120 cycles (40 days) was rated as "B (bad)", and a case when the red rust did not exist was rated as "G (good)". "G" was regarded as a pass level, and "B" and "VB" were each regarded as a fail level.

The post-coating corrosion resistance was evaluated through the following procedure.

Similarly, each of the manufactured hat formed products was subjected to the conversion treatment by using the conversion treatment solution PB-SX35T manufactured by Nihon Parkerizing Co., Ltd., and then the cation electrodeposition coating material Powernics 110 manufactured by Nippon Paint Co., Ltd. was coated with the thickness of approximately 10 μm. After that, a coated film at a vertical wall part of the formed product was cross-cut with a cutter, and the combined corrosion test (JASO M610-92) defined by Society of Automotive Engineers of Japan was performed for 180 cycles (60 days), and a blister width of the coating film at the cross-cut part was measured. At this time, an alloyed hot-dip galvanized steel sheet (GA: a deposition amount per one surface of 45 g/m$^2$) was used as a comparative material, and the test was performed after it was subjected to the conversion treatment, the electrodeposition coating, and the cross-cut was applied similarly. A case when the blister width of the coating film exceeded the GA was rated as "B (bad)", and a case when the blister width of the coating film was below the GA was rated as "G (good)", and a case when the blister width of the coating film was below half or less of the GA was rated as "VG (very good)". "G" and "VG" were each regarded as a pass level, and "B" was regarded as a fail level.

Evaluation results regarding the formed part corrosion resistance and the post-coating corrosion resistance according to the aforementioned references were collectively listed in Table 2-1, Table 2-2. Regarding samples of No. 20 to No. 22 listed in Table 2-2, since the number of layers of the Fe-Al-based plated layer was outside the scope of the present invention, detailed compositions of the Fe-Al-based plated layer was not measured, and evaluation of each obtained sample was not performed.

TABLE 1

| BASE MATERIAL | STEEL COMPONENT [mass %, BALANCE IS CONSISTING OF Fe AND IMPURITIES | | | | | | | | | | |
|---|---|---|---|---|---|---|---|---|---|---|---|
| No. | C | Si | Mn | Al | P | S | N | Ti | B | Cr | OTHERS |
| A1 | 0.22 | 0.5 | 1.2 | 0.05 | 0.010 | 0.030 | 0.005 | | 0.0021 | 0.40 | |
| A2 | 0.22 | 0.2 | 1.2 | 0.05 | 0.010 | 0.030 | 0.005 | 0.02 | 0.0021 | 0.20 | |
| A3 | 0.22 | 0.2 | 1.2 | 0.05 | 0.010 | 0.030 | 0.005 | 0.02 | 0.0021 | 0.80 | |
| A4 | 0.22 | 1.5 | 1.2 | 0.05 | 0.010 | 0.030 | 0.005 | | 0.0021 | 0.40 | |
| A5 | 0.22 | 0.2 | 2.0 | 0.05 | 0.010 | 0.030 | 0.005 | | 0.0021 | 0.40 | |
| A6 | 0.22 | 0.2 | 1.2 | 0.05 | 0.010 | 0.030 | 0.005 | 0.02 | 0.0021 | 0.40 | Ni: 0.2 |
| A7 | 0.22 | 0.2 | 1.2 | 0.05 | 0.010 | 0.030 | 0.005 | 0.02 | 0.0021 | 0.40 | Mo: 0.2 |
| A8 | 0.22 | 0.2 | 1.2 | 0.05 | 0.010 | 0.030 | 0.005 | 0.02 | 0.0021 | 0.40 | W: 0.2 |
| A9 | 0.22 | 0.2 | 1.2 | 0.05 | 0.010 | 0.030 | 0.005 | 0.02 | 0.0021 | 0.40 | V: 0.2 |
| A10 | 0.22 | 0.2 | 1.2 | 0.05 | 0.010 | 0.030 | 0.005 | 0.02 | 0.0021 | 0.40 | Nb: 0.01 |
| A11 | 0.22 | 0.2 | 1.2 | 0.05 | 0.010 | 0.030 | 0.005 | 0.02 | 0.0021 | 0.40 | Cu: 0.2 |
| A12 | 0.22 | 0.2 | 1.2 | 0.05 | 0.010 | 0.030 | 0.005 | 0.02 | 0.0021 | 0.40 | Sn: 0.2 |
| A13 | 0.22 | 0.2 | 1.2 | 0.05 | 0.010 | 0.030 | 0.005 | 0.02 | 0.0021 | 0.40 | Co: 0.2 |
| A14 | 0.22 | 0.2 | 1.2 | 0.05 | 0.010 | 0.030 | 0.005 | 0.02 | 0.0021 | 0.40 | Ca: 0.002 |
| A15 | 0.22 | 0.2 | 1.2 | 0.05 | 0.010 | 0.030 | 0.005 | 0.02 | 0.0021 | 0.40 | Mg: 0.002 |
| A16 | 0.22 | 0.2 | 1.2 | 0.05 | 0.010 | 0.030 | 0.005 | 0.02 | 0.0021 | 0.40 | REM: 0.002 |

TABLE 2-1

| SAMPLE | BASE MATERIAL | THICK-NESS | HEAT TREATMENT | HEATING TIME | MAXIMUM ATTAINED SHEET TEMPERATURE | TIME IN 600 TO 800° C. | Fe—Al-BASED PLATED LAYER [mass %] | | | | | | | | | |
|---|---|---|---|---|---|---|---|---|---|---|---|---|---|---|---|---|
| | | | | | | | A LAYER | | | | | B LAYER | | | | |
| No. | No. | [μm] | CONDITION | [s] | [° C.] | [s] | Al | Fe | Si | Mn | Cr | Al | Fe | Si | Mn | Cr |
| 1 | A1 | 35 | A | 500 | 950 | 200 | 45 | 52 | 2 | 0.3 | 0.3 | 25 | 61 | 11 | 1.4 | 0.8 |
| 2 | A2 | 35 | A | 500 | 950 | 200 | 45 | 53 | 1 | 0.3 | 0.1 | 26 | 62 | 10 | 1.2 | 0.4 |
| 3 | A3 | 35 | A | 500 | 950 | 200 | 44 | 53 | 2 | 0.4 | 0.2 | 26 | 62 | 9 | 1.3 | 1.3 |
| 4 | A4 | 35 | A | 500 | 950 | 200 | 45 | 52 | 2 | 0.4 | 0.3 | 21 | 63 | 14 | 1.2 | 0.8 |
| 5 | A5 | 35 | A | 500 | 950 | 200 | 45 | 53 | 1 | 0.3 | 0.2 | 27 | 61 | 9 | 1.7 | 0.8 |
| 6 | A6 | 35 | A | 500 | 950 | 200 | 46 | 51 | 2 | 0.3 | 0.2 | 28 | 60 | 10 | 1.2 | 0.8 |
| 7 | A7 | 35 | A | 500 | 950 | 200 | 43 | 55 | 1 | 0.3 | 0.3 | 24 | 64 | 9 | 1.4 | 0.8 |
| 8 | A8 | 35 | A | 500 | 950 | 200 | 44 | 52 | 3 | 0.2 | 0.3 | 26 | 62 | 9 | 1.5 | 0.9 |
| 9 | A9 | 35 | A | 500 | 950 | 200 | 45 | 52 | 2 | 0.3 | 0.2 | 24 | 63 | 10 | 1.4 | 0.9 |
| 10 | A10 | 35 | A | 500 | 950 | 200 | 43 | 53 | 3 | 0.2 | 0.2 | 23 | 64 | 10 | 1.5 | 0.8 |
| 11 | A11 | 35 | A | 500 | 950 | 200 | 41 | 55 | 3 | 0.4 | 0.2 | 25 | 62 | 10 | 1.3 | 0.9 |
| 12 | A12 | 35 | A | 500 | 950 | 200 | 47 | 50 | 2 | 0.3 | 0.2 | 26 | 64 | 8 | 1.3 | 0.6 |
| 13 | A13 | 35 | A | 500 | 950 | 200 | 48 | 50 | 1 | 0.3 | 0.2 | 25 | 63 | 9 | 1.4 | 0.8 |
| 14 | A14 | 35 | A | 500 | 950 | 200 | 46 | 52 | 1 | 0.2 | 0.3 | 28 | 60 | 10 | 1.3 | 0.7 |
| 15 | A15 | 35 | A | 500 | 950 | 200 | 45 | 51 | 3 | 0.2 | 0.2 | 30 | 60 | 7 | 1.4 | 0.7 |
| 16 | A16 | 35 | A | 500 | 950 | 200 | 47 | 51 | 1 | 0.2 | 0.2 | 25 | 64 | 8 | 1.2 | 0.9 |
| 17 | A1 | 35 | B | 500 | 950 | 60 | 45 | 51 | 3 | 0.2 | 0.3 | 22 | 73 | 4 | 0.2 | 0.1 |
| 18 | A1 | 35 | C | 300 | 850 | 150 | 40 | 51 | 7 | 0.8 | 0.7 | 27 | 62 | 9 | 1.3 | 0.7 |
| 19 | A1 | 35 | D | 100 | 700 | 30 | 89 | 2 | 8 | 0 | 0.2 | 56 | 35 | 7 | 1.3 | 0.6 |

TABLE 2-1-continued

| SAMPLE No. | Fe—Al-BASED PLATED LAYER [mass %] C LAYER Al | Fe | Si | Mn | Cr | D LAYER Al | Fe | Si | Mn | Cr | NUMBER DENSITY OF KIRKENDALL VOIDS | FORMED PART CORROSION RESISTANCE | POST-COATING CORROSION RESISTANCE | REMARKS |
|---|---|---|---|---|---|---|---|---|---|---|---|---|---|---|
| 1 | 44 | 53 | 2 | 0.3 | 0.2 | 4 | 90 | 4 | 1.2 | 0.8 | 35 | G | G | EXAMPLE |
| 2 | 44 | 53 | 2 | 0.2 | 0.1 | 5 | 91 | 2 | 1.0 | 0.5 | 34 | G | G | EXAMPLE |
| 3 | 41 | 55 | 3 | 0.4 | 0.3 | 2 | 93 | 2 | 1.1 | 1.6 | 33 | G | G | EXAMPLE |
| 4 | 45 | 52 | 2 | 0.4 | 0.2 | 1 | 92 | 5 | 1.2 | 0.8 | 36 | G | G | EXAMPLE |
| 5 | 43 | 53 | 3 | 0.4 | 0.2 | 6 | 90 | 1 | 1.5 | 0.6 | 36 | G | G | EXAMPLE |
| 6 | 41 | 54 | 4 | 0.2 | 0.2 | 2 | 92 | 4 | 1.2 | 0.7 | 33 | G | G | EXAMPLE |
| 7 | 42 | 55 | 2 | 0.3 | 0.2 | 4 | 92 | 1 | 1.3 | 0.9 | 37 | G | G | EXAMPLE |
| 8 | 41 | 56 | 2 | 0.2 | 0.3 | 2 | 92 | 4 | 1.2 | 0.8 | 34 | G | G | EXAMPLE |
| 9 | 43 | 53 | 3 | 0.4 | 0.2 | 4 | 90 | 3 | 1.2 | 0.9 | 38 | G | G | EXAMPLE |
| 10 | 42 | 53 | 4 | 0.2 | 0.2 | 2 | 91 | 4 | 1.3 | 0.9 | 32 | G | G | EXAMPLE |
| 11 | 44 | 52 | 3 | 0.4 | 0.2 | 4 | 92 | 2 | 1.2 | 0.6 | 32 | G | G | EXAMPLE |
| 12 | 41 | 56 | 2 | 0.4 | 0.2 | 5 | 90 | 3 | 1.3 | 0.6 | 35 | G | G | EXAMPLE |
| 13 | 41 | 54 | 4 | 0.4 | 0.2 | 2 | 93 | 3 | 1.2 | 0.8 | 37 | G | G | EXAMPLE |
| 14 | 42 | 53 | 4 | 0.4 | 0.2 | 4 | 90 | 4 | 1.2 | 0.8 | 38 | G | G | EXAMPLE |
| 15 | 41 | 55 | 3 | 0.3 | 0.2 | 3 | 93 | 1 | 1.3 | 0.9 | 35 | G | G | EXAMPLE |
| 16 | 42 | 55 | 2 | 0.2 | 0.3 | 3 | 91 | 4 | 1.2 | 0.7 | 35 | G | G | EXAMPLE |
| 17 | 43 | 54 | 2 | 0.2 | 0.3 | 4 | 93 | 2 | 0.2 | 0.1 | 50 | B | G | COMPARATIVE EXAMPLE |
| 18 | 35 | 57 | 6 | 0.8 | 0.6 | 15 | 75 | 8 | 1.2 | 0.6 | 5 | B | G | COMPARATIVE EXAMPLE |
| 19 | 26 | 61 | 11 | 1.1 | 0.9 | 46 | 50 | 3 | 0.2 | 0.3 | 0 | VB | B | COMPARATIVE EXAMPLE |

TABLE 2-2

| SAMPLE No. | BASE MATERIAL No. | THICK-NESS [μm] | HEAT TREATMENT CONDITION | HEATING TIME [s] | MAXIMUM ATTAINED SHEET TEMPERATURE [° C.] | TIME IN 600 TO 800° C. [s} | LAYER STRUCTURE OF Fe—Al-BASED PLATED LAYER | REMARKS |
|---|---|---|---|---|---|---|---|---|
| 20 | A1 | 70 | E | 700 | 1100 | 400 | 1 LAYER | COMPARATIVE EXAMPLE |
| 21 | A1 | 15 | F | 300 | 650 | 100 | 3 LAYERS | COMPARATIVE EXAMPLE |
| 22 | A1 | 15 | F | 300 | 600 | 100 | 2 LAYERS | COMPARATIVE EXAMPLE |

As it is clear from Table 2-1, samples of No. 1 to No. 16 corresponding to Example of the present application were excellent in both the formed part corrosion resistance and the post-coating corrosion resistance compared to sample of No. 17 to No. 19 corresponding to Comparative example.

Example 2

When the hot-stamped members were obtained by the similar manufacturing method as Example 1, results of hot-stamped members obtained by further making Mg or Ca contain for 0.02 mass % or more and 2 mass % or less as a plating bath composition were listed in Table 3. Here, the condition "A" in Example 1 was used as a heat treatment condition. A result where a thickness of each oxide layer formed by Mg oxide or Ca oxide was examined by a cross-sectional SEM was listed together in Table 3. Evaluation references of the formed part corrosion resistance and the post-coating corrosion resistance are the same as Example 1.

TABLE 3

| SAMPLE No. | BASE MATERIAL No. | Fe—Al-BASED PLATED LAYER [mass %] A LAYER Al | Fe | Si | Mn | Cr | B LAYER Al | Fe | Si | Mn | Cr | C LAYER Al | Fe | Si | Mn | Cr | D LAYER Al | Fe | Si | Mn | Cr |
|---|---|---|---|---|---|---|---|---|---|---|---|---|---|---|---|---|---|---|---|---|---|
| 31 | A10 | 42 | 54 | 3 | 0.2 | 0.2 | 24 | 63 | 10 | 1.5 | 0.8 | 42 | 53 | 4 | 0.2 | 0.2 | 2 | 91 | 4 | 1.3 | 0.9 |
| 32 | A10 | 44 | 53 | 2 | 0.2 | 0.2 | 24 | 64 | 9 | 1.5 | 0.8 | 42 | 54 | 3 | 0.2 | 0.2 | 2 | 92 | 4 | 1.1 | 0.9 |
| 33 | A10 | 43 | 54 | 2 | 0.2 | 0.2 | 25 | 62 | 10 | 1.5 | 0.8 | 42 | 52 | 5 | 0.2 | 0.2 | 2 | 91 | 4 | 1.3 | 0.9 |

TABLE 3-continued

| SAMPLE No. | NUMBER DENSITY OF KIRKENDALL VOIDS | OXIDE LAYER ELE-MENT | OXIDE LAYER THICK-NESS [μm] | FORMED PART CORROSION RESISTANCE | POST-COATING CORROSION RESISTANCE | REMARKS |
|---|---|---|---|---|---|---|
| 31 | 30 | Ca | 0.2 | G | VG | EXAMPLE |
| 32 | 33 | Mg | 0.2 | G | VG | EXAMPLE |
| 33 | 32 | Mg + Ca | 1.0 | G | VG | EXAMPLE |

As it is clear from Table 3, samples of No. 31 to No. 33 corresponding to Example in Table 3 where a preferable thickness of the oxide layer formed by the Mg oxide or Ca oxide was set to 0.1 μm or more and 3 μm or less are excellent in both the formed part corrosion resistance and the post-coating corrosion resistance compared to a sample of No. 10 in Table 2-1.

Example 3

Cold-rolled steel sheets (sheet thickness of 1.4 mm) having steel components listed in Table 1 were used as sample materials, these were each subjected to a hot-rolling process and a cold-rolling process, and recrystallization annealing and a hot-dip aluminum plating process were continuously performed as same as Example 1. A coiling temperature at the hot-rolling time was set to 700° C. or more and 800° C. or less, a non-oxidizing furnace-reduction furnace type line was used for a hot-dip Al plating, a plating deposition amount was adjusted to be about 30 g/m$^2$ or more and 120 g/m$^2$ or less per one surface through a gas wiping method after plating and then cooled. Plating bath compositions at this time were listed in Table 4.

The obtained each Al-plated steel sheet was subjected to blanking into 240 mm×300 mm, heating, and then the resultant was heated under the condition shown as the heat treatment condition A of Example 1 for hot-stamping, formed into a hat-shape, then quenched at a cooling rate of 50° C./s or more, and a holding time at a bottom dead center was set to 10 seconds to obtain a high-strength hot-stamped member.

A K-type thermocouple was spot-welded to the Al-plated steel sheet which was previously blanked into 240 mm×300 mm, and a steel sheet temperature during heating was measured. A heating time X when a steel sheet temperature Y was in a range of 600° C. or more and 800° C. or less during the hot-stamping heating was measured. Detailed manufacturing conditions were listed in Table 4.

The formed part corrosion resistance and the post-coating corrosion resistance were evaluated by the similar references as Example 1 regarding the hot-stamped members manufactured as stated above, and obtained results were collectively listed in Table 4.

TABLE 4

| SAMPLE No. | BASE MATERIAL No. | PLATING BATH COMPOSITION Al | Si | Fe | THICK-NESS [μm] | HEAT TREATMENT CONDTION | HEATING TIME [s] | MAXIMUM ATTAINED SHEET TEMPERATURE [° C.] | TIME IN 600 TO 800° C. [s] |
|---|---|---|---|---|---|---|---|---|---|
| 41 | A10 | 92 | 5 | 3 | 35 | A | 500 | 950 | 200 |
| 42 | A10 | 85 | 12 | 3 | 35 | A | 500 | 950 | 200 |
| 43 | A10 | 70 | 20 | 10 | 35 | A | 500 | 950 | 200 |
| 44 | A10 | 100 | 0 | 0 | 35 | A | 500 | 950 | 200 |

| SAMPLE | Fe—Al-BASED PLATED LAYER [mass %] A LAYER | | | | | B LAYER | | | | | C LAYER | | | | | D LAYER | | | | |
|---|---|---|---|---|---|---|---|---|---|---|---|---|---|---|---|---|---|---|---|---|
| No. | Al | Fe | Si | Mn | Cr | Al | Fe | Si | Mn | Cr | Al | Fe | Si | Mn | Cr | Al | Fe | Si | Mn | Cr |
| 41 | 45 | 52 | 3 | 0.3 | 0.2 | 21 | 71 | 6 | 1.3 | 0.8 | 45 | 53 | 2 | 0.2 | 0.3 | 4 | 92 | 2 | 1.3 | 0.8 |
| 42 | 43 | 53 | 4 | 0.2 | 0.2 | 20 | 63 | 15 | 1.5 | 0.8 | 43 | 52 | 5 | 0.2 | 0.2 | 2 | 91 | 5 | 1.3 | 0.9 |
| 43 | 42 | 50 | 7 | 0.3 | 0.7 | 23 | 55 | 20 | 1.3 | 0.7 | 41 | 52 | 6 | 0.3 | 0.2 | 13 | 72 | 13 | 1.2 | 0.6 |
| 44 | 54 | 44 | 0 | 0.2 | 0.3 | 47 | 52 | 1 | 0.2 | 0.2 | 41 | 58 | 0 | 0.1 | 0.2 | 9 | 88 | 2 | 1.1 | 0.8 |

| SAMPLE No. | NUMBER DENSITY OF KIRKENDALL VOIDS | FORMED PART CORROSION RESISTANCE | POST-COATING CORROSION RESISTANCE | REMARKS |
|---|---|---|---|---|
| 41 | 29 | G | G | EXAMPLE |
| 42 | 35 | G | G | EXAMPLE |
| 43 | 45 | B | B | COMPARATIVE EXAMPLE |
| 44 | 48 | VB | B | COMPARATIVE EXAMPLE |

As it is clear from Table 4, samples of No. 41 to No. 42 corresponding to Example of the present application are excellent in the formed part corrosion resistance and the post-coating corrosion resistance compared to samples of No. 43 to No. 44 corresponding to Comparative example.

Preferred embodiments of the present invention have been described above in detail with reference to the accompanying drawings, but the present invention is not limited to the embodiments. It should be understood that various changes and modifications are readily apparent to those skilled in the art to which the present invention belongs within the scope of the technical idea as set forth in claims, and those should also be covered by the technical scope of the present invention.

INDUSTRIAL APPLICABILITY

According to the present invention, a Fe-Al-based plated high-strength hot-stamped member excellent in post-coating corrosion resistance and a manufacturing method thereof can be provided, resulting in improvement in automobile collision safety and improvement in fuel efficiency and reduction in exhaust gas such as $CO_2$ due to reduction in automobile weight.

What is claimed is:

1. A Fe-Al-based plated hot-stamped member, comprising:

a Fe-Al-based plated layer located on one surface or both surfaces of a base material, wherein the base material contains, in mass %, C: 0.1% or more and 0.5% or less Si: 0.01% or more and 2.00% or less Mn: 0.3% or more and 5.0% or less P: 0.001% or more and 0.100% or less S: 0.0001% or more and 0.100% or less Al: 0.01% or more and 0.50% or less Cr: 0.01% or more and 2.00% or less B: 0.0002% or more and 0.0100% or less N: 0.001% or more and 0.010% or less, and a balance comprising Fe and impurities, wherein the Fe-Al-based plated layer has a thickness of 10 μm or more and 60 μm or less, and formed by four layers of an A layer, a B layer, a C layer and a D layer sequentially from a surface toward the base material, each of the four layers is a Fe-Al-based inter metallic compound containing components listed below to be 100 mass % or less in total, with a balance comprising impurities, and the D layer further contains Kirkendall voids whose cross-sectional area is 3 $\mu m^2$ or more and 30 $\mu m^2$ or less for 10 pieces/6000 $\mu m^2$ or more and 40 pieces/6000 $\mu m^2$ or less, the A layer and the C layer:

Al: 40 mass % or more and 60 mass % or less

Fe: 40 mass % or more and less than 60 mass %

Si: greater than 0 mass % and 5 mass % or less

Mn: greater than 0 mass % and less than 0.5 mass %

Cr: greater than 0 mass % and less than 0.4 mass % the B layer:

Al: 20 mass % or more and less than 40 mass %

Fe: 50 mass % or more and less than 80 mass %

Si: over 5 mass % and 15 mass % or less

Mn: 0.5 mass % or more and 10 mass % or less

Cr: 0.4 mass % or more and 4 mass % or less the D layer:

Al: greater than 0 mass % and less than 20 mass %

Fe: 60 mass % or more and less than 100 mass %

Si: greater than 0 mass % and 5 mass % or less

Mn: 0.5 mass % or more and 2.0 mass % or less

Cr: 0.4 mass % or more and 4 mass % or less.

2. The Fe-Al-based plated hot-stamped member according to claim 1, further comprising:

an oxide layer formed by Mg oxide and/or Ca oxide with a thickness of 0.1 μm or more and 3 μm or less at a surface of the A layer.

3. The Fe-Al-based plated hot-stamped member according to claim 1, wherein the base material further contains, in mass %, at least any of W: 0.01 to 3.00%

Mo: 0.01 to 3.00%

V: 0.01 to 2.00%

Ti: 0.005 to 0.500%

Nb: 0.01 to 1.00%

Ni: 0.01 to 5.00%

Cu: 0.01 to 3.00%

Co: 0.01 to 3.00%

Sn: 0.005 to 0.300%

Sb: 0.005 to 0.100%

Ca: 0.0001 to 0.01%

Mg: 0.0001 to 0.01%

Zr: 0.0001 to 0.01%

REM: 0.0001 to 0.01% instead of a part of Fe in the balance.

4. A manufacturing method of the Fe-Al-based plated hot-stamped member according to claim 1, comprising:

subjecting a slab of steel having a base material component containing, in mass %, C: 0.1% or more and 0.5% or less Si: 0.01% or more and 2.00% or less Mn: 0.3% or more and 5.0% or less P: 0.001% or more and 0.100% or less S: 0.0001% or more and 0.100% or less Al: 0.01% or more and 0.50% or less Cr: 0.01% or more and 2.00% or less B: 0.0002% or more and 0.0100% or less N: 0.001% or more and 0.010% or less, with the balance comprising Fe and impurities, to hot-rolling, pickling, cold-rolling, and then after blanking a steel sheet which is continuously subjected to annealing and hot-dip aluminum plating, the steel sheet after blanking is heated at 850° C. or more and 1050° C. or less with a heating time of 150 seconds or more and 650 seconds or less, the heating time which is a time from putting the steel sheet after blanking into a heating facility to taking the steel sheet after blanking out, just after that, the steel sheet is formed into a desired shape and quenched at a cooling rate of 30° C./s or more, wherein a composition of a hot-dip aluminum plating bath used for the hot-dip aluminum plating contains:

Al: 80 mass % or more and 96 mass % or less

Si: 3 mass % or more and 15 mass % or less

Fe: 1 mass % or more and 5 mass % or less to be 100 mass % or less in total, with the balance comprising impurities, and a steel sheet temperature Y (° C.) and a heating time X (seconds) in the heating are controlled such that: the heating time X where Y is 600° C. or more and 800° C. or less is 100 seconds or more and 300 seconds or less; and a point where a first derivative (dY/dX) of Y with respect to X becomes zero exists in a range where Y is 600° C. or more and 800° C. or less.

* * * * *